US008673094B2

(12) United States Patent
Hashimura et al.

(10) Patent No.: US 8,673,094 B2
(45) Date of Patent: Mar. 18, 2014

(54) CASE HARDENING STEEL AND MANUFACTURING METHOD THEREOF

(75) Inventors: Masayuki Hashimura, Tokyo (JP); Kei Miyanishi, Tokyo (JP); Shuji Kozawa, Tokyo (JP); Manabu Kubota, Tokyo (JP); Tatsuro Ochi, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

(21) Appl. No.: 13/696,714

(22) PCT Filed: Oct. 5, 2011

(86) PCT No.: PCT/JP2011/072999

§ 371 (c)(1),
(2), (4) Date: Nov. 7, 2012

(87) PCT Pub. No.: WO2012/046779

PCT Pub. Date: Apr. 12, 2012

(65) Prior Publication Data

US 2013/0048156 A1 Feb. 28, 2013

(30) Foreign Application Priority Data

Oct. 6, 2010 (JP) ..... 2010-226478

(51) Int. Cl.
*C22C 38/28* (2006.01)

(52) U.S. Cl.
USPC ..... 148/546; 148/333

(58) Field of Classification Search
USPC ..... 148/546, 333, 330
See application file for complete search history.

(56) References Cited

U.S. PATENT DOCUMENTS

2013/0048156 A1* 2/2013 Hashimura et al. ..... 148/546

FOREIGN PATENT DOCUMENTS

| | | |
|---|---|---|
| CN | 101573463 | 11/2009 |
| JP | 11-335777 | 12/1999 |
| JP | 2001-303174 | 10/2001 |
| JP | 2004-176176 | 6/2004 |
| JP | 2004-183064 | 7/2004 |
| JP | 2004-204263 | 7/2004 |
| JP | 2005-240175 | 9/2005 |
| JP | 2007-217761 | 8/2007 |
| JP | 2009-024245 | 2/2009 |
| JP | 4528363 | 8/2010 |

OTHER PUBLICATIONS

English language translation of JP 4528363 B, Aug. 18, 2010.*
International Search Report dated Dec. 27, 2011, issued in corresponding PCT Application No. PCT/JP2011/072999.
Chinese Office Action dated Jun. 24, 2013 issued in corresponding Chinese Application No. 201180023015.4. [With English Translation].

* cited by examiner

*Primary Examiner* — Scott Kastler
(74) *Attorney, Agent, or Firm* — Kenyon & Kenyon LLP

(57) ABSTRACT

A case hardening steel includes by mass %, C: 0.1% to 0.5%, Si: 0.01% to 1.5%, Mn: 0.3% to 1.8%, S: 0.001% to 0.15%, Cr: 0.4% to 2.0%, Ti: 0.05% to 0.2%, Al: limited to 0.2% or less, N: limited to 0.0050% or less, P: limited to 0.025% or less, O: limited to 0.0025% or less, and the balance of Fe and inevitable impurities, wherein the number d of sulfide having an equivalent circle diameter more than 5 μm per 1 $mm^2$ and a mass percentage [S] of S satisfy: $d \leq 500 \times [S]+1$.

13 Claims, 6 Drawing Sheets

CASE HARDENING STEEL AND MANUFACTURING METHOD THEREOF

FIELD OF THE INVENTION

The present invention relates to a case hardening steel and a manufacturing method thereof in which carburizing and quenching is performed after hot forming such as hot forging, cold forming such as cold forging or form rolling, cutting, and the like have been performed.

This application is a national stage application of International Application No. PCT/JP2011/072999, filed Oct. 5, 2011, which claims priority to Japanese Patent Application No. 2010-226478, filed Oct. 6, 2010, the content of which is incorporated herein by reference.

DESCRIPTION OF RELATED ART

Since rotating parts such as gears or bearings, or rotation transmission parts such as constant velocity joints or shafts need hardness in their surfaces, carburizing and quenching is performed on these parts. For example, these carburized parts are manufactured by forming medium carbon alloy steel for mechanical structural use, which is defined in JIS G 4052, JIS G 4104, JIS G 4105, JIS G 4106, or the like, into a predetermined shape through plastic forming such as hot forging, warm forging, cold forging, or form rolling, or cutting, and by carburizing and quenching the formed steel.

When the carburized parts are manufactured, accuracy of the shape of the parts may be deteriorated by heat treatment distortion due to the carburizing and quenching. Particularly, in parts such as a gears or constant velocity joints, heat treatment distortion becomes the cause of noise or vibration and may decrease fatigue characteristics at the contact surface. Moreover, in shafts or the like, if bending is increased by the heat treatment distortion, power transmission efficiency or fatigue characteristics are adversely affected. A major cause of the heat treatment distortion is coarse grains which are nonuniformly generated by heating while the carburizing and quenching is being performed.

Previously, after forging, the occurrence of coarse grains has been suppressed by performing annealing before the carburizing and quenching. However, there is a problem in that the manufacturing costs increases if the annealing is performed. Moreover, since a high surface pressure is applied on rotating parts such as a gears or bearings, deep carburizing is performed. In the deep carburizing, in order to shorten carburizing time, a carburizing temperature which generally is about 930° C. is increased up to a temperature range of 990 to 1090° C. Thereby, in deep carburizing, coarse grains are easily generated.

In order to suppress occurrence of the coarse grains when the carburizing and quenching is performed, the quality of the case hardening steel, that is, the quality of the material before the plastic forming, is important. In order to suppress coarsening of crystal grains at high temperatures, fine precipitates are effective, and a case hardening steel which uses precipitates of Ni and Ti, AlN, or the like has been suggested (for example, Patent Citations 1 to 5).

PATENT CITATION

[Patent Citation 1] Japanese Unexamined Patent Application, First Publication No. H11-335777

[Patent Citation 2] Japanese Unexamined Patent Application, First Publication No. 2001-303174

[Patent Citation 3] Japanese Unexamined Patent Application, First Publication No. 2004-183064

[Patent Citation 4] Japanese Unexamined Patent Application, First Publication No. 2004-204263

[Patent Citation 5] Japanese Unexamined Patent Application, First Publication No. 2005-240175

SUMMARY OF THE INVENTION

Problems to be Solved by the Invention

However, if the fine precipitates are used to suppress the occurrence of the coarse grains, the case hardening steel is hardened by precipitation strengthening. Moreover, the case hardening steel is also hardened by the addition of the alloying elements that generate the precipitates. Thereby, in steel which can prevent the coarse grains from being generated at high temperatures, a decrease in cold formability with respect to cold forging, cutting, or the like can arise as new problems.

Particularly, the cutting is a processing which requires high accuracy close to the final shape, and a slight increase in hardness significantly influences the accuracy of the cutting. Therefore, when the case hardening steel is used, it is very important not only to prevent occurrence of the coarse grains but also to view machinability (ease of cutting of a material). Conventionally, it is known that addition of machinability improvement elements such as Pb or S is effective in order to improve the machinability.

However, Pb is an environmentally hazardous substance, and the addition of Pb to steels is becoming limited in view of the importance of environmental technology. Moreover, S forms MnS or the like in the steel and improves machinability. However, coarse MnS which is elongated by hot forming, easily becomes the starting point of a fracture when rolling, hot forging, or cold forging is performed, which becomes the cause of processing defects in many cases. Thereby, the addition of a large amount of S easily decreases formability and forgeability at the time of hot rolling and cold rolling, or easily decreases mechanical properties such as rolling fatigue.

In the present invention, in order to be applied in carburized parts which need good fatigue characteristics, particularly, bearing parts, rotating parts, gears, or the like which need rolling fatigue characteristics, it is possible to provide the case hardening steel which has an excellent characteristics preventing coarse grains, an excellent cold formability, an excellent machinability, and an excellent fatigue characteristics after the carburizing and quenching; and the manufacturing method thereof. Here, the case hardening steel is used after the hot forming such as the hot forging, the cold forming such as the cold forging or the form rolling, the cutting, and the carburizing and quenching are performed.

Methods for Solving the Problem

The inventors have intensively studied to solve the above problems. As a result, if the carburizing and quenching is performed to the steel to which Ti is added, Ti-based precipitates act as the starting point of the fatigue fracture, and fatigue characteristics, particularly, the rolling fatigue characteristic are easily deteriorated. Therefore, the inventors have obtained the following findings and completed the present invention. First, if the Ti-based precipitates are finely dispersed by limiting the amount of N, increasing a hot rolling temperature, or the like, it is possible to strike a balance between both the characteristics preventing coarse grains and fatigue characteristics. Moreover, adding S to the steel is effective in improving the machinability. However, it is important to control the size and shape of sulfides by adding Ti. In addition, since Ti also forms the sulfide and combines with MnS, Ti is effective in refinement of MnS.

The summery of the present invention is as follows.

(1) A case hardening steel according to an aspect of the present invention includes: by mass %, as a chemical composition, C: 0.1% to 0.5%, Si: 0.01% to 1.5%, Mn: 0.3% to 1.8%, S: 0.001% to 0.15%, Cr: 0.4% to 2.0%, Ti: 0.05% to 0.2%, Al: limited to 0.2% or less, N: limited to 0.0050% or less, P: limited to 0.025% or less, O: limited to 0.0025% or less, and the balance of iron and inevitable impurities, wherein the number d of sulfide having an equivalent circle diameter more than 5 μm per 1 $mm^2$ and a mass percentage [S] of S satisfy: $d \leq 500 \times [S]+1$.

(2) The case hardening steel according to (1), may further include, by mass %, as the chemical composition, at least one selected from: Nb: less than 0.04%, Mo: 1.5% or less, Ni: 3.5% or less, V: 0.5% or less, B: 0.005% or less, Ca: 0.005% or less, Mg: 0.003% or less, and Zr: 0.005% or less.

(3) In the case hardening steel according to (2), [Al]/[Ca] which is a ratio of a mass percentage [Al] of Al to a mass percentage [Ca] of Ca may be 1 or more and 100 or less.

(4) In the case hardening steel according to any one of (1) to (3), the maximum equivalent circle diameter D μm of the sulfide and the mass percentage [S] of S may satisfy: $D \leq 250 \times [S]+10$.

(5) In the case hardening steel according to any one of (1) to (4), the amount of Mn may be 1.0% or less, and [Mn]/[S] which is a ratio of a mass percentage [S] of S to a mass percentage [Mn] of Mn may be 100 or less.

(6) In the case hardening steel according to any one of (1) to (5), the ratio of bainite may be 30% or less in the microstructure.

(7) In the case hardening steel according to any one of (1) to (6), the maximum equivalent circle diameter of Ti-based precipitates may be 40 μm or less.

(8) A method of manufacturing a case hardening steel according to another aspect of the present invention includes, casting steel having a chemical composition which contains: by mass %, C: 0.1% to 0.5%, Si: 0.01% to 1.5%, Mn: 0.3% to 1.8%, S: 0.001% to 0.15%, Cr: 0.4% to 2.0%, Ti: 0.05% to 0.2%, Al: limited to 0.2% or less, N: limited to 0.0050% or less, P: limited to 0.025% or less, O: limited to 0.0025% or less, and the balance of Fe and inevitable impurities, at an average cooling rate of 12 to 100° C./min; maintaining the steel in a soaking temperature range of 1250° C. to 1320° C. for 3 to 180 min; hot-rolling the steel so that a finish rolling is performed in a finishing temperature range of 840° C. to 1000° C. after heating the steel to a temperature range of 1150° C. to 1320° C.; and cooling the steel so that the average cooling rate in a temperature range of 800° C. to 500° C. is 1° C./s or less.

(9) In the method of manufacturing the case hardening steel according to (8), the chemical composition may further contain, by mass %, at least one selected from Nb: less than 0.04%, Mo: 1.5% or less, Ni: 3.5% or less, V: 0.5% or less, B: 0.005% or less, Ca: 0.005% or less, Mg: 0.003% or less, and Zr: 0.005% or less.

(10) In the method of manufacturing the case hardening steel according to (9), [Al]/[Ca] which is a ratio of a mass percentage [Al] of Al to a mass percentage [Ca] of Ca may be 1 or more and 100 or less.

(11) In the method of manufacturing the case hardening steel according to any one of (8) to (10), the amount of Mn may be 1.0% or less, and [Mn]/[S] which is a ratio of a mass percentage [S] of S to a mass percentage [Mn] of Mn may be 100 or less.

Effects of the Invention

The case hardening steel according to the present invention has excellent fatigue characteristics after the carburizing and quenching, and excellent formability such as forgeability, machinability, or the like. That is, in the case hardening steel according to the present invention, in the hot forging and the subsequent cutting, improved formability is obtained, coarsening of the crystal grain can be suppressed even though carburizing is performed under a condition of higher temperature and shorter time than conventional at the time of the carburizing, and improved fatigue characteristics can be obtained. Moreover, in the case hardening steel according to the present invention, cold deformation characteristics are improved even when the cold forging is performed, abnormal grain growth of the crystal grain in the carburizing can be suppressed even when normalizing after the cold forging is skipped, and deterioration in accuracy of dimension by quenching distortion and deterioration in the fatigue strength caused by this are significantly decreased. In addition, in the case hardening steel according to the present invention, the conventional problem that the machinability decreases if various alloying elements are added so as to prevent the occurrence of coarse grains is solved, high accuracy in the part shape can be achieved, and tool life becomes longer.

That is, in the parts in which the case hardening steel according to the present invention is used as the material, even when high temperature carburizing is performed or normalizing is skipped before the carburizing, it is possible to prevent coarse grains from being generated, sufficient strength characteristics such as rolling fatigue characteristics or the like, can be obtained, and therefore, the present invention significantly contributes to the industry.

Specifically, when the case hardening steel according to the present invention is used, processes shown in FIG. 1 are assumed. In addition, when hot forging is performed, carburizing is performed at a higher temperature than conventional after cutting, and the carburizing is completed for a shorter time than conventional. In addition, when cold forging is performed, in order to avoid an abnormal grain growth at the time of the carburizing, in general, normalizing is performed after the cold forging. However, when the case hardening steel according to the present invention is used, the normalizing can be skipped, and high performance can be achieved with carburized parts such as gears or bearings.

DETAILED DESCRIPTION OF THE INVENTION

Coarsening of crystal grains due to carburizing and quenching is prevented by suppressing grain growth using precipitates as pinning particles. Particularly, finely precipitating Ti-based precipitates which are mainly composed of TiC and TiCS during cooling after hot forming are significantly effective in preventing occurrence of coarse grains. Moreover, in order to prevent occurrence of coarse grains, it is preferable to finely precipitate Nb-based precipitates such as NbC in a case hardening steel.

However, if the amount of N contained in steel is large, coarse TiN generated in casting is not dissolved in heating of hot rolling and hot forging, and may remain in large quantities. If the coarse TiN remains in the steel, TiC, TiCS, and NbC are precipitated by TiN acted as precipitation nuclei at the time of the carburizing and quenching, which may hinder fine dispersion of the precipitates. Therefore, in order to prevent occurrence of the coarse grains at the time of the carburizing and quenching by fine Ti-based precipitates or Nb-based precipitates, it is important to decrease the amount of N and to dissolve the Ti-based precipitates or the Nb-based precipitates during heating in hot forming.

In a method of manufacturing the case hardening steel, after a steel is cast by controlling solidification rate (cooling rate: 12 to 100° C./min) in continuous casting, first, it is necessary to uniformly heat the steel in a heating temperature of 1250° C. to 1320° C. so that precipitates of Ti, Nb and Al are dissolved in the steel. Particularly, it is important to increase the heating temperature of the hot forming such as hot rolling or hot forging to 1150° C. to 1320° C. and to dissolve the Ti-based precipitates and the Nb-based precipitates in the steel. Next, after the hot forming, that is, after the hot rolling or hot forging, it is necessary to perform a slow cooling at a cooling rate of 1° C./s or less in a precipitation temperature range of the Ti-based precipitates and the Nb-based precipitates. As a result, it is possible to finely disperse the Ti-based precipitates and the Nb-based precipitates in the case hardening steel. In addition, if ferrite grains in the steel before the carburizing and quenching are too fine, coarse grains are easily generated during the carburizing heating. Thereby, in order to not generate the fine ferrites, it is necessary to control a finishing temperature of the hot rolling or the hot forging to 840° C. to 1000° C.

Figure 1:
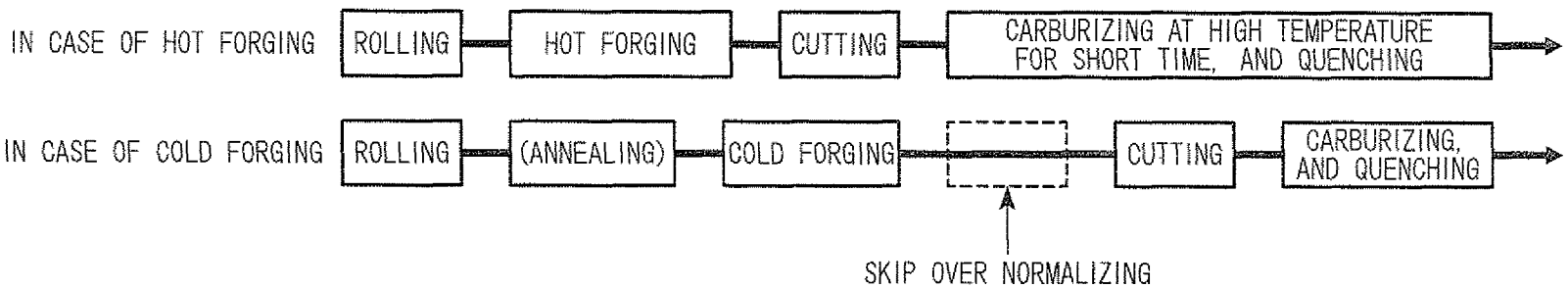
FIG. 1 is a diagram showing an example of an outline in a process of hot forming (hot forging) or cold forming (cold forging), cutting, and carburizing and quenching which are assumed when a case hardening steel according to the present invention is used.

Moreover, when the case hardening steel according to the present invention is processed into part shapes such as a gears, for example, as shown in FIG. 1, before the carburizing and quenching after the bloom subjected to the continuous casting is rolled, the hot forging or the cold forging and the cutting (in the case of gears, gear forming is performed by gear cutting) are performed. At this time, sulfide such as MnS decreases cold forgeability. However, the sulfide is significantly effective in cutting (for example, gear cutting). That is, the sulfide in the case hardening steel (workpiece material) suppresses change in the tool shape due to abrasion of a cutting tool, and therefore, the sulfide exhibits an effect which extend the so-called tool life. Particularly, in the case of precise shapes such as gears, if the cutting tool life is short, it is impossible to stably form the gear shape. Thereby, the cutting tool life influences not only the manufacturing efficiency or the costs but also the shape accuracy of the parts.

Therefore, in order to enhance machinability, it is preferable to generate the sulfide in the steel. On the other hand, in the hot rolling or the hot forging, particularly, in many cases, sulfide such as coarse MnS is elongated. Moreover, if the size (length) of the sulfide increases, there is a high probability that the sulfide is found as defects in the parts, and performance in the part is decreased. Therefore, it is important to control not only the size of the sulfide, but also the shape of the sulfide so that the sulfide is not elongated. Moreover, in order to suppress coarsening of the sulfide, it is preferable to control the solidification rate during the casting. The cooling rate (average cooling rate) at the time of casting greatly influences the size of MnS, the size of MnS decreases as the cooling rate increases, and on the contrary, the size of MnS increases as the cooling rate decreases. Thereby, as described below, from the standpoint of the size of MnS, the cooling rate should be increased. On the other hand, with the fast cooling rate, cracks are generated on the surface of the bloom, and therefore, in some cases, problems occurs during casting, or it is necessary to remove defects by conditioning after the casting.

In order to effectively and finely generate the sulfide mainly including MnS, a range in the solidification cooling rate (average solidification cooling rate) is controlled to 12° C./min to 100° C./min. When the cooling rate is less than 12° C./min, since the solidification is too slow, the crystallized sulfide mainly including MnS coarsens, and it is difficult to finely disperse the sulfide so as to satisfy Equation 2 described below. In addition, when the cooling rate is more than 100° C./min, the density of the sulfide mainly including fine MnS generated is saturated, hardness of the bloom (steel before rolling) increases, and there is a concern that cracks may be generated. Accordingly, the cooling rate during the casting needs to be 12° C./min to 100° C./min. Particularly, in order to more reliably and finely disperse the sulfide, it is preferable that the cooling rate during casting be 15° C./min to 100° C./min. The cooling rate can be obtained by controlling the size of a mold cross section, a casting rate, or the like by appropriate values. This cooling control can be applied to both the continuous casting method and an ingot-making method.

Figure 3:
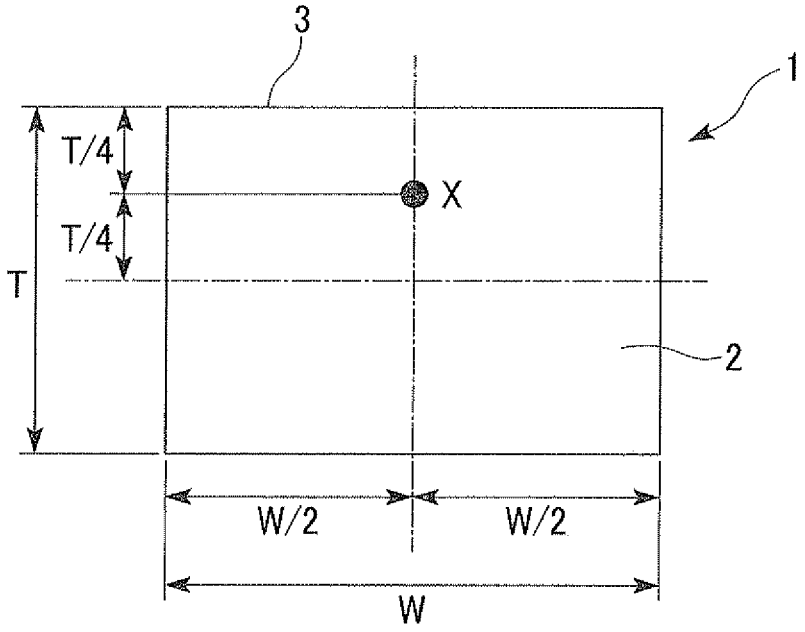
FIG. 3 shows a diagram showing a position in which cooling rate is measured during solidification of steel.

Here, the solidification cooling rate means a rate when being cooled from a liquidus temperature to a solidus temperature on a center line in a width of the bloom and in a portion (¼ portion) of ¼ in thickness of the bloom in a cross section (cross section perpendicular to casting direction) of the bloom shown in FIG. 3. The solidification cooling rate can be obtained by Equation 1 below from a secondary dendrite arm spacing of a solidification microstructure in the cross section of the bloom after the solidification.

$$R_C=(\lambda_2/770)^{-1/0.41} \quad \text{(Equation 1)}$$

Here, $R_C$ means the solidification cooling rate (° C./min), $\lambda_2$ means the spacing (μm) of the secondary dendrite arm.

In order to decrease the soft sulfides such as MnS by a chemical composition control in steel, adding Ti to the steel and generating the Ti-based sulfide such as TiCS are effective. However, if the soft MnS decreases, the added S does not contribute to improvement of machinability. Therefore, in order to improve the machinability, it is important to control the size and the shape of the soft sulfide in the molten steel to which not only S but also Ti is added. Thus, it is preferable to control the size and shape of the sulfide by adding Ti required for suppressing the grain growth and refining the sulfide, and controlling the amount of S.

The machinability and the cold formability will be further described.

During the cold forming, the sulfide mainly including MnS is deformed and becomes a starting point of fractures. Particularly, coarse MnS decreases cold forgeability such as limiting compressibility. Moreover, if the MnS in the steel coarsens, anisotropy in characteristics of the steel is generated according to the shape of the MnS. In order to apply the case hardening steel to various and complicated parts, stable mechanical properties are required in all directions. Thereby, in the case hardening steel according to the present invention, it is preferable to refine the sulfide mainly including MnS and to control the shape of the sulfide to a substantially spherical shape. In addition, it is preferable that a change in the shape before and after the cold forming such as forging be decreased.

On the other hand, from the standpoint of machinability, it is important to increase the amount of S. The tool life during machining is improved by adding S, and the effect is determined by the total amount of S and is not easily subjected to the influence of the shape of sulfide. Thereby, both the cold forgeability and the machinability (tool life) can be achieved by increasing the amount of the added S and controlling the shape of the sulfide. In the case hardening steel, it important not only to prevent coarse grains from being generated during the carburizing and quenching but also to secure the cold formability and the machinability. If the amount of S increases, the machinability is improved, but the cold formability decreases. Here, in the case of comparing the steel including the same amount of S, it is also important to secure further improved cold formablity.

Figure 2A:
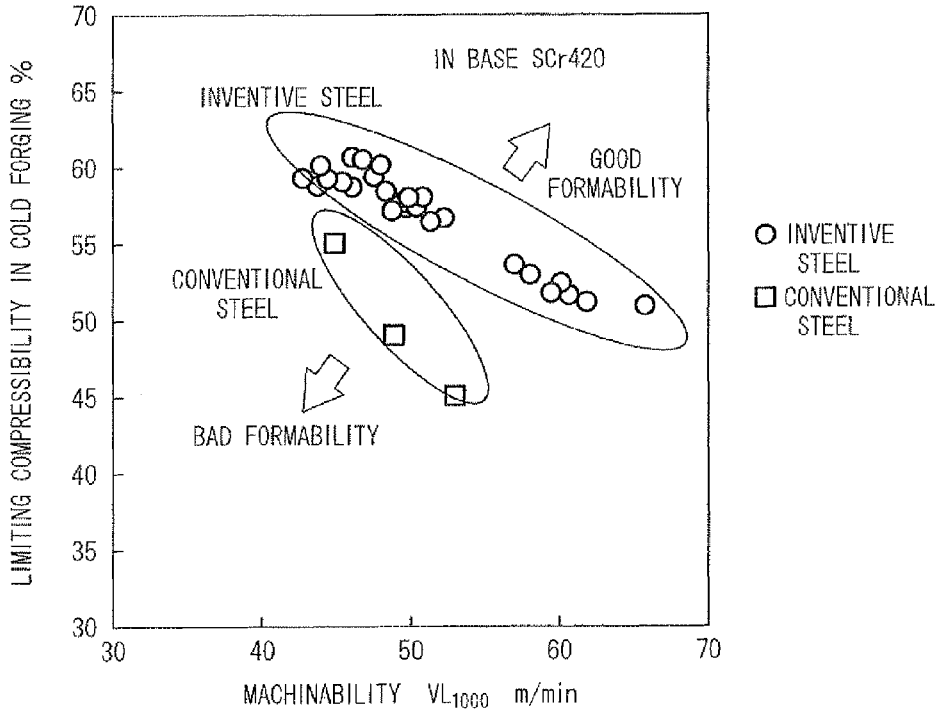
FIG. 2A is a diagram illustrating a balance between machinability and cold formability of the case hardening steel when the amount of S and a morphology of sulfide are changed in a steel equivalent to SCr 420.
Figure 2B:
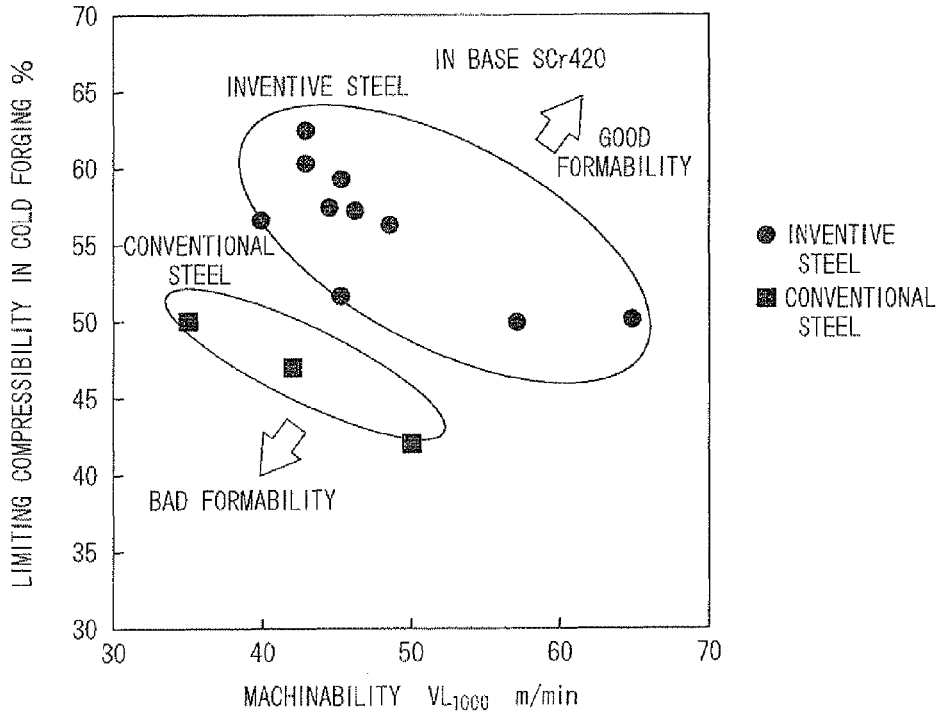
FIG. 2B is a diagram illustrating a balance between machinability and cold formablity of the case hardening steel when the amount of S and a morphology of sulfide are changed in a steel equivalent to SCM 420.

FIGS. 2A and 2B shows a relationship between the machinability and the cold formability in the case hardening steel having good pinning characteristics which suppress the coarse grains from being generated during the carburizing and quenching. Here, in FIG. 2A, the amount of S is changed in a steel equivalent to SCr 420. Moreover, in FIG. 2B, the amount of S is changed in a steel equivalent to SCM 420 in which Mo is added to the steel equivalent to SCr 420. In the present invention, it is possible to achieve both hot or cold forgeability (limiting compressibility) and machinability (drill machinability $VL_{1000}$) while maintaining good pinning characteristics (generation temperature of coarse grains is more than 1000° C.). In FIGS. 2A and 2B, a balance between the machinability and the cold formability is improved as the steel is positioned in the upper right, and the balance is changed according to the kind of the steel (particularly, the amount of element which enhances hardenability).

Hereinafter, the case hardening steel according to an embodiment of the present invention will be described in detail. First, chemical components will be described. Hereinafter, mass % (the amount of chemical component) in a chemical composition is denoted by only %.

[C]

C is an element which increases strength of the steel. In order to secure sufficient tensile strength, the amount of C needs to be 0.1% or more, and is preferably 0.15% or more. On the other hand, if the amount of C is more than 0.5%, the cold formability is deteriorated by significant hardening, and therefore, the amount of C needs to be 0.5% or less. Moreover, in order to secure toughness of the core after carburizing, it is preferable that the amount of C be 0.4% or less and it is more preferable that the amount of C be 0.3% or less.

[Si]

Si is an element which is effective in deoxidation of steel and the amount of Si needs to be 0.01% or more. Moreover, Si is an element which strengthens the steel and improves hardenability, and it is preferable that the amount of Si be 0.02% or more. In addition, Si is an element which is effective in increasing grain boundary strength, and Si is an element which is effective in extending service life of bearing parts and rotating parts by suppressing the microstructure change or deterioration of the material in the rolling fatigue process. Thereby, in a case of obtaining higher strength, it is more preferable that the amount of Si be 0.1% or more. Particularly, in order to enhance rolling fatigue strength, it is preferable that the amount of Si be 0.2% or more.

On the other hand, if the amount of Si is more than 1.5%, cold formability such as cold forging is deteriorated by hardening, therefore the amount of Si needs to be 1.5% or less. Moreover, in order to enhance cold formability, it is preferable that the amount of Si be 0.5% or less. Particularly, when the cold forgeability is emphasized, it is preferable that the amount of Si be 0.25% or less.

[Mn]

Mn is an element which is effective in deoxidation of the steel and enhances strength and hardenability of the steel and the amount of Mn needs to be 0.3% or more. On the other hand, if the amount of Mn is more than 1.8%, cold forgeability is deteriorated due to an increase in the hardness, therefore the amount of Mn needs to be 1.8% or less. A preferable range of the amount of Mn is 0.5 to 1.2%. Moreover, when cold forgeability is emphasized, it is preferable that the amount of Mn be 0.75% or less. In addition, Mn is an element which improves hardenability. However, in an aspect of generation of the sulfide, Mn is an element which generates MnS in the steel along with S. Mn has an effect which hardens the steel by increasing a fraction of bainite from an aspect of hardenability, and Mn decreases cold forgeability or machinability from an aspect of formability. Thereby, in the aspect of generation of the sulfide, if the amount of Mn increases and [Mn]/[S] which is a ratio of an amount [S] of S with respect to an amount [Mn] of Mn increases, coarse MnS is easily generated. Particularly, in order to decrease the fraction of bainite and sufficiently secure cold forgeability, it is preferable that the amount of Mn be 1.0 or less and [Mn]/[S] be 100 or less. Moreover, [Mn]/[S] may be 2 or more.

[S]

S is an element which forms MnS in the steel and improves machinability. In order to enhance the machinability, the amount of S needs to be 0.001% or more and it is preferable that the amount of S be 0.01% or more. On the other hand, if the amount of S is more than 0.15%, intergranular embrittlement is generated by grain boundary segregation, therefore the amount of S needs to be 0.15% or less. In addition, for considering a high strength part, it is preferable that the amount of S be 0.05% or less. Moreover, in regard to strength, cold formability, and the stability, it is more preferable that the amount of S be 0.03% or less.

Moreover, conventionally, in the bearing parts and the rotating parts, since MnS deteriorates the rolling fatigue life, it was considered that there is a need to decrease S. However, the inventors found that the amount of S greatly influences machinability for the improvement, and the shape of the sulfide greatly influences cold formability for the improvement. In the embodiment, the shape of the sulfide is controlled by the addition of Ti or Nb, the control of cooling rate (solidification cooling rate) at the time of solidification, and heating for soaking. Ti forms complex sulfide including Mn and the complex sulfide does not extend like simple MnS. Moreover, if the solidification cooling rate decreases, coarse MnS is generated in the liquid phase before the solidification is completed. In addition, since uniform heating generates the complex sulfide or finely generates MnS which is precipitated from the solute Mn and solute S, the heating for soaking is important. Since MnS is not sufficiently generated at a low temperature, FeS or the like is generated, the steel is embrittled, and the required amount of MnS cannot be secured. Thereby, it is preferable that the amount of S be 0.01% or more. When machinability is emphasized, it is more preferable that the amount of S be 0.02% or more.

[Cr]

Cr is an effective element which improves strength and hardenability of the steel and the amount of Cr needs to be 0.4% or more. In addition, in the bearing parts and the rotating parts, Cr increases the amount of residual γ on the surface after carburizing, suppresses the microstructure change and the material deterioration in the rolling fatigue process, and therefore is effective in an extended service life. Thereby, it is preferable that the amount of Cr be 0.7% or more and it is more preferable that the amount of Cr be 1.0% or more. On the other hand, if 2.0% or more of Cr is added to the steel, cold formability is deteriorated due to increase of hardness, therefore the amount of Cr needs to be 2.0% or less. In order to enhance cold forgeability, it is preferable that the amount of Cr be 1.5% or less.

[Ti]

Ti is an element which generates precipitates such as carbide, carbosulfide, nitride in the steel. In order to prevent coarse grains from being generated during the carburizing and quenching using fine TiC and TiCS, the amount of Ti needs to be 0.05% or more and it is preferable that the amount of Ti be 0.1% or more. On the other hand, if more than 0.2% of Ti is added to the steel, since cold formability is significantly deteriorated by the precipitation hardening, the amount of Ti needs to be 0.2% or less. Moreover, in order to improve rolling fatigue characteristics by controlling the precipitation of TiN, it is preferable that the amount of Ti be 0.15% or less. In addition, it is possible to refine the precipitates of MnS by adding Ti.

[Al]

Al is a deoxidizing agent and the amount of Al is preferably 0.005% or more. However, the amount of Al is not limited to this. On the other hand, if the amount of Al is more than 0.2%, AlN is not dissolved by heating of hot forming and remains in the steel. Thereby, coarse AlN acts as precipitation nuclei of precipitates of Ti or Nb, and generation of fine precipitates is inhibited. In order to prevent coarsening of crystal grains during the carburizing and quenching, the amount of Al needs to be 0.2% or less. If the amount of Al is a range of 0.05% or less, heat treatment characteristics during normalizing or carburizing and quenching are not greatly changed compared to the conventional steel, therefore for practical purposes, it is preferable that the amount of Al be 0.05% or less. On the other hand, since Al has an effect which improves machinability, in order to obtain more improved machinability, it is preferable that the amount of Al be 0.03% or more. If the balance between the heat treatment characteristics and the machinability is considered, it is preferable that the amount of Al be 0.15% or less.

If coarse AlN remains during heating of hot forming, similar to TiN, the coarse AlN inhibits generation of fine particles which act as pinning particles. Therefore, realistically, limiting the precipitation amount of AlN included in the case hardening steel is effective. If the precipitation amount of AlN is excessive, since coarse grains are easily generated during the carburizing and quenching, the precipitation amount of AlN of the case hardening steel is preferably limited to 0.01% or less and is more preferably limited to 0.005% or less.

In order to suppress the precipitation amount of AlN of the case hardening steel, promoting the solution heat treatment by increasing heating temperature of hot forming is effective. Since the temperature at which AlN is dissolved in the steel is lower than the temperature at which TiN is dissolved, AlN is more easily dissolved during heating of the hot rolling compared to TiN. In the embodiment, since the amount of N of the case hardening steel is limited, if the steel is heated to the temperature at which the AlN is dissolved, Ti-based precipitates and Nb-based precipitates can also be dissolved.

Specifically, since the steel is sufficiently heated in the heat treatment of the very early stage such as a stage immediately after casting and AlN is dissolved, harmful influences in the subsequent rolling, forging, and carburizing can be suppressed. Thereby, the bloom is sufficiently heated to 1250° C. or more and held (soaked) at a stage in which a billet or the like is manufactured from a bloom. The higher temperature (soaking temperature) is preferable, and it is preferable that the steel is heated at a temperature more than 1250° C. and soaked. If the soaking temperature is more than 1350° C., since materials of a heating furnace such as a refractory are significantly damaged, the soaking temperature needs to be 1320° C. or less.

Moreover, during hot forming after the rolling or at the time of the subsequent cooling, the precipitation rate or the growth rate of AlN is slower compared to those of Ti-based precipitates and Ni-based precipitates. Thereby, by preventing residual of AlN during heating of hot forming, the precipitation amount of AlN which is included in the case hardening steel can be decreased, and it is possible to prevent coarse grains from being generated during carburizing and quenching using fine Ti-based precipitates and Nb-based precipitates.

Moreover, the precipitation amount of AlN can be measured by performing chemical analysis of extraction residue of the steel. The extraction residue is extracted by dissolving the steel in bromine methanol solution and by filtering the solution with a filter of 0.2 μm. In addition, even when the filter of 0.2 μm is used, since the filter generates clogging by precipitates at the filtering process, fine precipitates of 0.2 μm or less are also extracted.

[N]

N is an element which generates nitride. In order to suppress generation of coarse TiN or AlN, the amount of N is limited to be 0.0050% or less. This is because the coarse TiN or AlN acts as precipitation nuclei of Ti-based precipitates mainly including TiC or TiCS, Nb-based precipitates mainly including NbC, or the like and inhibits dispersion of fine precipitates. Thereby, it is preferable that the amount of N be 0.0040% or less and it is more preferable that the amount of N be 0.0035% or less. The lower limit of the amount of N is not particularly required to be limited and is 0%.

[P]

P is an impurity and is an element which increases deformation resistance during cold forming and deteriorates toughness. If excessive P is contained in the steel, cold forgeability is deteriorated. Therefore, it is necessary that the amount of P is limited to 0.025% or less. Moreover, in order to improve fatigue strength by suppressing embrittlement of the crystal grain boundary, it is preferable that the amount of P be 0.015% or less. The lower limit of the amount of P is not particularly required to be limited and is 0%.

[O]

O is an impurity, forms oxide inclusions in the steel, and damages formability. Therefore, the amount of O is limited to 0.0025% or less. In addition, since the case hardening steel of the embodiment contains Ti, oxide inclusions including Ti are generated, and TiC is precipitated on the oxide inclusions which act as the precipitation nuclei. If the oxide inclusions increases, generation of fine TiC during hot forming may be suppressed. Thereby, in order to suppress coarsening of the crystal grains during the carburizing and quenching by finely dispersing the Ti-based precipitates mainly including TiC and TiCS, it is preferable that the amount of O be limited to 0.0020% or less. Moreover, in the bearing parts and the rotating parts, rolling fatigue fracture may be generated from the oxide inclusions which act as the starting point. Thereby, when the case hardening steel is applied to the bearing parts or the rotating parts, in order to improve the rolling lifetime, it is more preferable that the amount of O be limited to 0.0012% or less. The lower limit of the amount of O is not particularly required to be limited and is 0%.

Moreover, the chemical composition which includes the above-described basic chemical components (basic elements), and the balance of Fe and inevitable impurities is the basic composition according to the present invention. However, in addition to the basic composition (instead of a portion of Fe in the balance), the chemical composition may further include the following elements (optional elements) if necessary in the present invention. Moreover, even though the optional elements are inevitably mixed into the steel, the elements do not damage the effects according to the present embodiment.

[Nb]

In addition to the above-described basic elements, in order to suppress occurrence of coarse grains during the carburizing and quenching, similar to Ti, it is preferable to add Nb which generates carbonitride.

Similar to Ti, Nb is an element which combines with C and N in the steel and generates carbonitride. According to addition of Nb, the effect which suppresses occurrence of the coarse grains due to the Ti-based precipitates is further remarkable. Even though the amount of the added Nb is minute, compared to the case where Nb is not added, Nb is significantly more effective for preventing the coarse grains. This is because Nb is dissolved in the Ti-based precipitates and suppresses coarsening of the Ti-based precipitates. In order to suppress occurrence of coarse grains at the time of heating of the carburizing and quenching, it is preferable that the amount of Nb be 0.005% or more. However, the amount of Nb is not limited thereto. On the other hand, if excessive Nb of 0.04% or more is added to the steel, in the hot forming, the steel is embrittled, and the excessive Nb causes flaws easily. In addition, in the cold forming, the steel is hardened and cold forgeability, machinability, or carburizing characteristics may be deteriorated. Therefore, it is preferable that the amount of Nb be less than 0.04%. When cold formability such as cold forgeability and machinability are emphasized, it is more preferable that the amount of Nb be less than 0.03%. Moreover, when carburization is emphasized in addition to the formability, it is preferable that the amount of Nb be less than 0.02%.

In addition, it is known that even a minute amount of Nb influences hot ductility, and in the steel used in gears, the hot ductility becomes more sensitive to the amount of Nb. Thereby, addition of Nb is effective in the control of Ti-based precipitates or microstructures. However, also from the standpoint of ductility in rolling or hot forming such as hot forging, the addition of Nb should be controlled. In this way, since the effect of the addition of Nb is seen by the addition of Nb of 0.005% or more, excessive addition of Nb such as more than 0.04% should be avoided. In addition, in a case where alloy cost is decreased, it is not necessary to intentionally add Nb, and the lower limit of the amount of Nb is 0%.

Moreover, in order to achieve both characteristics of preventing coarse grains (pinning characteristics) and formability, it is preferable to adjust a total of Nb amount [Nb] and Ti amount [Ti]. The preferable range of [Ti]+[Nb] is 0.07% or more and less than 0.17%. Particularly, in parts in which high temperature carburizing or cold forging is applied, a more preferable range of [Ti]+[Nb] is more than 0.09% and less than 0.17%.

In addition, in order to improve the strength or hardenability of the steel, one or more selected from Mo, Ni, V, and B may be added.

[Mo]

Mo is an element which enhances strength and hardenability of the steel and may be added in the steel, if necessary. Also in order to improve the extended service life by increasing the amount of the residual γ of the surface layer of the carburized parts and further by suppressing the microstructure change and the material deterioration at the rolling fatigue process, Mo is effective. However, if more than 1.5% of Mo is added to the steel, machinability and cold forgeability may be deteriorated due to an increase of hardness. Therefore, it is preferable that the amount of Mo be 1.5% or less. Since Mo is an expensive element, from the standpoint of the manufacturing costs, it is preferable that the amount of Mo be 0.5% or less. In this way, in order to decrease the alloy cost, it is not necessary to intentionally add Mo to the steel, and the lower limit of the amount of Mo is 0%. In addition, when Mo is added and used, it is preferable that the amount of Mo be 0.05% or more and it is more preferable that the amount of Mo be 0.1% or more.

[Ni]

Similar to Mo, Ni is an element which is effective in improvement of strength and hardenability of the steel and may be added to the steel, if necessary. However, if more than 3.5% of Ni is added to the steel, since machinability and cold forgeability are deteriorated due to an increase of hardness, it is preferable that the amount of Ni be 3.5% or less. Since Ni also is an expensive element, from the standpoint of the manufacturing costs, it is preferable that the amount of Ni be 2.0% or less and it is more preferable that the amount of Ni be 1.0% or less. In this way, in order to decrease the alloy cost, it is not necessary to intentionally add Ni to the steel, and the lower limit of the amount of Ni is 0%. In addition, when Ni is added and used, it is preferable that the amount of Ni be 0.1% or more and it is more preferable that the amount of Ni be 0.2% or more.

[V]

V is an element which improves the strength and the hardenability if dissolved in the steel and may be added to the steel, if necessary. If the amount of V is more than 0.5%, since the machinability and the cold forgeability are deteriorated due to an increase of hardness, it is preferable that the amount of V be 0.5% or less and it is more preferable that the amount of V be 0.2% or less. In order to decrease the alloy cost, it is not necessary to intentionally add V to the steel and the lower limit of the amount of V is 0%. In addition, when V is added and used, it is preferable that the amount of V be 0.05% or more and it is more preferable that the amount of V be 0.1% or more.

[B]

B is an element which enhances the hardenability of the steel by addition of a minute amount and may be added to the steel, if necessary. Moreover, B generates iron boron carbide in a cooling process after hot rolling, increases growth rate of ferrite, and promotes softening. In addition, B improves the grain boundary strength of the carburized parts and also is effective in improvement of fatigue strength and impact strength. However, if more than 0.005% of B is added to the steel, the above effect is saturated and the impact strength is deteriorated, therefore it is preferable that the amount of B be 0.005% or less and it is more preferable that the amount of B be 0.003% or less. In order to decrease the alloy cost, it is not necessary to intentionally add B to the steel, and the lower limit of the amount of B is 0%.

In addition, in order to control deoxidation and the shape of the sulfide, one or more selected from Ca, Mg, and Zr may be added.

[Ca]

Ca is a deoxidizing element which generates oxide in the steel and may be added to the steel, if necessary. In general, oxide in the steel due to deoxidation of Al is $Al_2O_3$. Since $Al_2O_3$ is hard, $Al_2O_3$ has harmful influences which decrease machinability. However, if Ca is added, $Al_2O_3$ which is a basic oxide and Ca generate Al—Ca based complex oxide and the steel can be slightly softened. Thereby, a decrease in machinability can be suppressed due to deoxidation of Al. Moreover, also in the steel making stage, adhesion of $Al_2O_3$ to the refractory can be suppressed, and harmful influences such as nozzle clogging can be suppressed.

In addition, since Ca slightly hardens MnS due to the fact that Ca and MnS generate complex sulfide, elongation of MnS during rolling or forging is suppressed, and cracks which is formed by the sulfide which acts as their starting point during cold forging can be suppressed. However, if too much Ca is added to the steel, since a large amount of CaS is generated and the steel becomes hard, machinability is adversely affected. In this way, Ca is an element effective in both aspects of control of oxide as an countermeasure against erosion and control of sulfide as a measure against forging crack. In order to obtain an effect of Ca addition, the amount of Ca is preferably 0.0003% or more, more preferably 0.0005% or more, and most preferably 0.0008% or more. Moreover, from the standpoint of machinability, the amount of Ca is preferably 0.005% or less, more preferably 0.003% or less, and most preferably 0.002% or less. In addition, in order to decrease the alloy cost, it is not necessary to intentionally add Ca to the steel, and the lower limit of the amount of Ca is 0%.

A ratio of the amount of Al [Al] with respect to the amount of Ca [Ca] also is important. If the [Al]/[Ca] indicating the ratio is extremely small, deoxidation due to Al is insufficient, and Ca is consumed as oxide. In this case, the effect of Ca with respect to the control of the sulfide is insufficient. On the contrary, if [Al]/[Ca] is extremely large, an effect of Ca with respect to the control of oxide is insufficient. Therefore, in the case where Ca is added to the steel, a range of [Al]/[Ca] is preferably 1 or more and 100 or less and more preferably 6 or more and 100 or less.

[Mg] and [Zr]

Mg and Zr are elements which generate oxide and sulfide and may be added to the steel, if necessary. Since Mg and Zr control deformability of MnS, Mg and Zr suppress the elongation of MnS due to hot forming. Particularly, even though only minute amounts of Mg and Zr are contained in the steel, a significant effect is exhibited. In addition, in order to stabilize the amount of Mg and Zr in the steel, it is preferable to control the amount of Mg or the amount of Zr depending on the refractory including Mg or Zr.

Mg is an element which generates oxide and sulfide. Complex sulfide (Mn, Mg)S including Mn, MnS, or the like are generated due to the fact that Mg is contained in the steel, and elongation of MnS can be suppressed. A minute amount of Mg is effective in the control of the shape of MnS, when Mg is added to the steel and formability is enhanced, therefore it is preferable that the amount of Mg be 0.0002% or more. In addition, oxide of Mg is finely dispersed and acts as a nucleation site of the sulfide such as MnS. When generation of coarse sulfide is suppressed using oxide of Mg, it is preferable that the amount of Mg be 0.0003% or more. Moreover, if Mg is added to the steel, the sulfide is slightly hard and is difficult to elongate by hot forming. In order to control the shape of the sulfide so as to improve machinability and not to damage cold formability, it is preferable that the amount of Mg be 0.0005% or more. Moreover, the hot forging has an effect which uniformly disperses the fine sulfide and is effective in improvement of cold formability. In addition, in order to decrease the alloy cost, it is not necessary to intentionally add Mg to the steel, and the lower limit of the amount of Mg is 0%.

On the other hand, since oxide of Mg easily floats on the molten steel, the yield is low, and from the standpoint of the manufacturing cost, it is preferable that the amount of Mg be 0.003% or less. Moreover, if Mg is excessively added, a large amount of oxide is generated in the molten steel, which may generate problems in the steel making such as adhesion to the refractory or nozzle clogging. Therefore, it is more preferable that the amount of Mg be 0.001% or less.

Zr is an element which generates nitride in addition to oxide and sulfide. If a minute amount of Zr is added to the molten steel, Zr is combined with Ti in molten steel and fine oxide, sulfide, and nitride are generated. Therefore, the addition of Zr is significantly effective in the control of inclusions and precipitates. When Zr is added to the steel, the morphology of inclusions is controlled, and the formability is enhanced, and therefore it is preferable that the amount of Zr be 0.0002% or more. Moreover, oxide, sulfide, and nitride including Zr and Ti act as precipitation nuclei of MnS during solidification. Zr and Ti penetrate to MnS which is precipitated in the periphery of the oxide, the sulfide, and the nitride which include Zr and Ti, and deformability decreases. Therefore, in order to suppress deformation of MnS by adding Zr and prevent elongation of MnS due to hot forming, it is preferable that the amount of Zr be 0.0003% or more. On the other hand, since Zr is an expensive element, from the standpoint of the manufacturing cost, it is preferable that the amount of Zr be 0.005% or less and it is more preferable that the amount of Zr be 0.003% or less. Moreover, in order to decrease the alloy cost, it is not necessary to intentionally add Zr to the steel, and the lower limit of the amount of Zr is 0%.

As described above, the case hardening steel according to the present embodiment has the chemical composition which consists of the above-described basic elements, and the balance of Fe and inevitable impurities, or the chemical composition which consists of the above-described basic elements, at least one selected from the above-described optional elements, and the balance Fe and inevitable impurities.

[Sulfide]

Since MnS is effective in improvement of machinability, it is necessary to secure the number density. On the other hand, since the elongated coarse MnS damages cold formability, it is necessary to control the size and the shape of MnS. The inventors examined a relationship between characteristics regarding the sulfide, such as the amount of S and the size and the shape of MnS, and formability, such as machinability and cold formability. As a result, if the average equivalent circle diameter of MnS which was observed by an optical microscope was more than 5 μm, it was found that the MnS became the starting point in which cracks are generated during cold forming. The average equivalent circle diameter of MnS is a diameter of a circle which has the same area as that of MnS and can be obtained by image analysis.

Next, the inventors examined influences by distribution of the sulfide. Sulfide such as MnS in hot rolled material having a diameter of 30 mm was observed by a scanning electron microscope, the relationship between characteristics of the sulfide such as the size, the aspect ratio, and the number density and formability such as cold formability and machinability was established. The observation of the sulfide was performed at ½ radius portion (portion between the surface and center of hot rolled material) of a cross section parallel to the rolling direction. 10 fields of view each having an area of 50 μm×50 μm were observed, and the equivalent circle diameter, the aspect ratio, and the number of the sulfide-based inclusions in the fields of view were obtained. In addition, the fact that the inclusions were sulfide was observed by energy dispersive X-ray analysis attached to a scanning electron microscope.

The number of the sulfides having an average equivalent circle diameter more than 5 μm was measured, and the number density d was obtained by dividing the value by the measured area. If the sulfide is finely dispersed, the sulfide can act as pinning particles at the time of an austenite grain growth during the carburizing. Accordingly, if the number density of relatively large sulfide having the equivalent circle diameter of 5 μm or more is small, there is much fine sulfide. Thus, it is possible to achieve both formability with respect to forging, cutting, or the like, and carburizing characteristics and fatigue characteristics. Since the number density d (number/$mm^2$) of the sulfide (particles (number) per 1 $mm^2$ of sulfides having equivalent circle diameter more than 5 μm) is subjected to the influence of the amount of S, in order to achieve both the machinability and the cold formability, from various tests regarding a relationship between the number density d of the sulfide and the amount of S [S], it was found that the number density d (number/$mm^2$) of the sulfide was required to satisfy the following experimental Equation 2.

$$d \leq 500[S]+1 \quad \text{(Equation 2)}$$

(Here, [S] indicates the amount (mass %) of S.)

In addition, in MnS and the complex sulfide of Mn and Ti, the sulfide of the maximum size acts as the fracture starting point in a region to which a load is applied at the time of the deformation in the forging, of being used as the parts, and of the fatigue after the carburizing. The trend is subjected to the influence of the amount of S, and if the amount of S increases, the maximum size of the sulfide increases. The maximum sulfide which includes not only Ti-based sulfide but also Mn-based sulfide (MnS) having small amount of Ti should be considered.

The inventors performed various tests regarding the relationship between the amount of S and the maximum sulfide size. As a result, when the maximum equivalent circle diameter D (μm) of the observed sulfide satisfies the following Equation 3, it was confirmed that good forgeability (hot and cold) could be obtained and good fatigue characteristics could be obtained compared to the steel having the same amount of S.

$$D \leq 250[S]+10 \quad \text{(Equation 3)}$$

(Here, [S] indicates the amount (mass %) of S.)

In the embodiment, the size of the sulfide can be controlled so that the maximum equivalent circle diameter D (μm) of the sulfide satisfies Equation 3 by performing a chemical composition control from the casting stage.

If D (μm) is more than 250 [S]+10, forgeability and fatigue characteristics decrease, and only the same performance as the conventional steel containing the same amount of S may be exhibited. Therefore, it is preferable that the upper limit of D (μm) be 250 [S]+10.

[Ti-Based Precipitates]

In addition, if coarse Ti-based precipitates are present in the steel, the precipitates act as the starting point of contact fatigue fracture, and fatigue characteristics may be deteriorated. Contact fatigue strength is a required characteristic of the carburized parts and includes rolling fatigue characteristic and surface fatigue strength. In order to enhance the contact fatigue strength, it is preferable that the maximum equivalent circle diameter (maximum diameter) of the observed Ti-based precipitates be less than 40 μm.

Next, microstructure of the case hardening steel according to the embodiment will be described.

[Bainite]

It is preferable that a ratio of bainite in the microstructure of the case hardening steel be limited to 30% or less. This is because it is preferable to generate fine precipitates in the grain boundary in order to prevent coarse grains from being generated during the carburizing and quenching. That is, if the ratio of the bainite which is generated during cooling after the hot forming is more than 30% in the microstructure, it is difficult to precipitate Ti-based precipitates and Nb-based precipitates in a phase interface. Moreover, suppressing the ratio of the bainite to 30% or less is effective in improvement of cold formability or machinability. In addition, like high temperature carburizing or the like, in a case where conditions with respect to prevention of coarse grains are strict, it is preferable that the ratio of the bainite be limited to 20% or less, and it is more preferable that the ratio be limited to 10% or less. In addition, when the high temperature carburizing after cold forging is performed, or the like, it is preferable that the ratio of the bainite be limited to 5% or less.

[Ferrite Grains]

If ferrite grains of the case hardening steel are too fine, the coarse grains are easily generated during the carburizing and quenching. This is because austenite grains are excessively coarsened during the carburizing and quenching. Particularly, if a grain size number of ferrite is more than 11 which is defined in JIS G 0551 (2005), coarse grains are easily generated. On the other hand, if the grain size number of ferrite of the case hardening steel is less than 8 which is defined in JIS G 0551, ductility is deteriorated, and cold formability may be adversely affected. Therefore, it is preferable that the grain size number of ferrite of the case hardening steel be within a range of 8 to 11 which are defined in JIS G 0551. If the amount of S increases, the sulfide increases, number of the ferrite grains which are generated on the nucleus of the sulfide increases. Therefore, the ferrite grains tend to be fine.

[Manufacturing Method/Solidification Cooling Rate]

Next, a method of manufacturing the case hardening steel according to an embodiment of the present invention will be described.

Steel is prepared as molten steel through a general method using a converter, an electric furnace, or the like, adjustment of chemical components in the steel is performed, the steel is subjected to a casting process and a billeting process if necessary, and a steel is obtained. A wire rod or a steel bar is manufactured by performing hot forming, that is, hot rolling or hot forging with respect to the steel.

Many sulfides in the steel are generated before the solidification (in the molten steel) or during the solidification, and the size of the sulfide is greatly influenced by cooling rate during the solidification. The embodiment uses a method other than the conventional method by paying attention in that a thermal history before and after the solidification influences generation and growth of the sulfide. That is, in order to prevent coarsening of the sulfide, it is important to control the cooling rate during the solidification. The cooling rate during the solidification is defined as the cooling rate in ½ portion (a position indicated by a solid circle, that is, a position X of T/4 from the surface in the direction of a bloom thickness T) of a distance from a bloom surface 3 to a center line in a bloom thickness T on a center line (W/2) of a bloom width W on a bloom cross-section 2 of a bloom 1 shown in FIG. 3.

In order to control generation of the sulfide mainly including MnS or TiS, it is preferable to control a range of solidification cooling rate (average solidification cooling rate). Specifically, in order to suppress coarsening of the sulfide, the cooling rate during the solidification needs to be 12° C./min or more, and it is preferable that the cooling rate be 15° C./min or more. In addition, as described above, the cooling rate during the solidification can be confirmed from the secondary arm spacing of dendrite. When the cooling rate is less than 12° C./min, the solidification is too slow, the crystallized sulfide mainly including MnS or TiS is coarsened, and the sulfide is difficult to be finely dispersed. On the other hand, when the cooling rate is more than 100° C./min, the number density of the fine sulfide mainly including MnS is saturated, the hardness of the bloom increases, and there is a concern that cracks may be generated. Accordingly, the cooling rate during the casting needs to be 12 to 100° C./min. Moreover, in order to more reliably prevent the crack of the bloom, the cooling rate during the casting is preferably 50° C./min or less and more preferably 20° C./min or less.

This cooling rate can be obtained by controlling size of a mold cross section, casting rate, or the like to appropriate values. Moreover, the cooling control can be applied to both the continuous casting method and the ingot-making method.

Moreover, since it is considered that MnS is crystallized in the liquid phase in the vicinity of a solidification point of the steel, the size of MnS decreases as the cooling rate increases, and the size of MnS increases as the cooling rate decreases. Thereby, in the embodiment compared to the cooling conditions of the conventional continuous casting machine and the conventional method of manufacturing the production model ingot, the molten steel is solidified by an extremely fast cooling rate, and the size of MnS is suppressed so as to be small.

Figure 6:
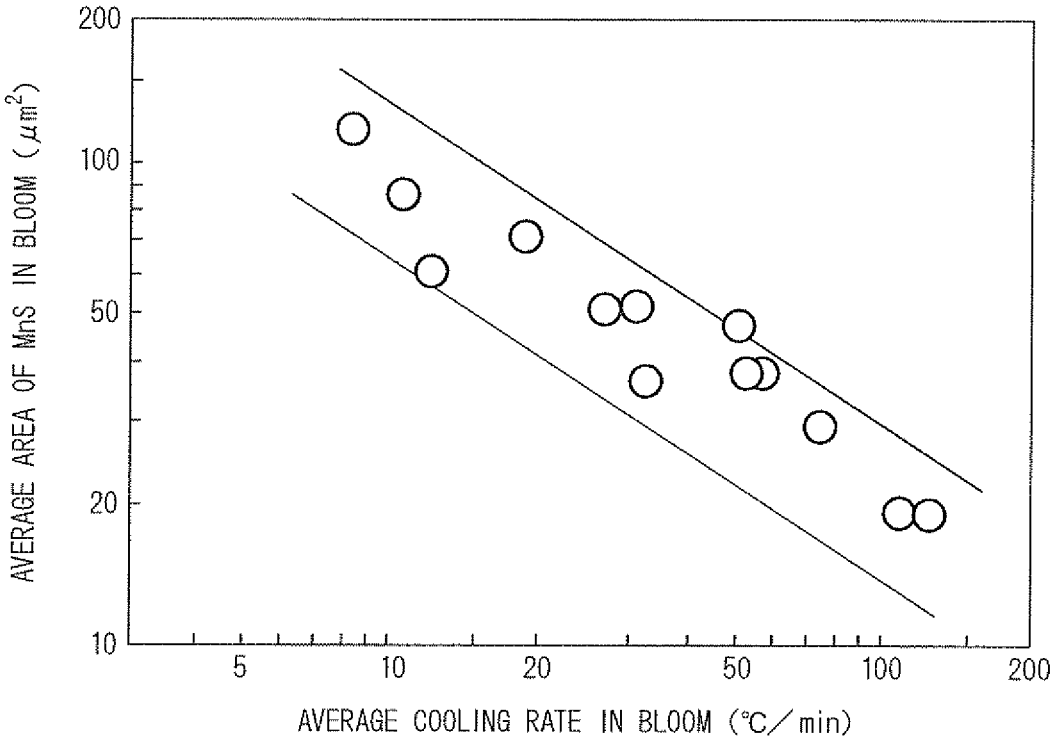
FIG. 6 is a diagram showing an example of a relationship between an average cooling rate in a bloom and an average area of MnS.

FIG. 6 shows an example of a relationship between average cooling rate in the bloom and an average area of MnS in the case of controlling the cooling rate by adjusting the casting conditions of the mold size, the cooling conditions, or the like while considering the relationship between the casting condition and the cooling rate during the conventional continuous casting or the casting of the production model ingot in casting tests. As shown in FIG. 6, if the average cooling rate of the bloom is increased, the average area of MnS (that is, average equivalent circle diameter) can be decreased.

Here, in order to increase the cooling rate during the solidification, a method which decreases the mold size can be adopted as a simple method. However, in this method, it is difficult to maintain the quality of the product. That is, when the size of the bloom decreases, since a reduction by rolling from the bloom to the rolled product (steel bar) decreases, it is difficult to obtain effects of high quality of crimping of gas defects, homogenization of segregation, or the like by the rolling, and many defects or segregations easily remain in the product (case hardening steel). Thereby, in this case, the inhomogeneous portion due to the defects or the segregations acts as the starting point of the fracture and irregularity is generated in the hardenability. Therefore, the quality of the case hardening steel may be deteriorated.

The bloom is reheated as it is and the case hardening steel is manufactured by performing the hot forming, or the steel obtained from the bloom by a billeting process is reheated and the case hardening steel is manufactured by performing hot forming. In general, the bloom is formed into a billet by billeting, the billet is reheated after being cooled in room temperature, and the case hardening steel is manufactured. Moreover, in the manufacturing of the parts such as gears, hot forging may be added.

[Manufacturing Method/Soaking-Rolling-Forging]

In order to alleviate alloy element-concentrated portion in the bloom even after the solidification is completed, the bloom is placed under as high temperature as possible, and embrittlement elements such as P and Mn should be uniformly diffused. Thereby, the temperature of the bloom is maintained at 600° C. or more after the casting, the bloom is directly inserted into a heating furnace at the billeting. In addition, the bloom is placed during 20 minutes or more at high temperature of 1200° C. or more in the billeting, and diffusion of P, Mn, and S is promoted. In addition, the heating and the holding have an effect which dissolves Ti-based and Nb-based precipitates.

After the solidification, when the bloom or the ingot which is cooled to room temperature once is used, the bloom or the ingot is reheated up to 1250° C. to 1320° C. and placed in the temperature range during 3 minutes or more, and it is preferable that alloy elements such as P, Mn, or Cr are sufficiently diffused and Ti-based and Nb-based nitrides which are precipitated in the solidification process are dissolved in the steel. As describe above, since the heating for soaking generates complex sulfide including Ti, Mn, or the like or finely generates MnS which is precipitated from the solute Mn and solute S, the heating for soaking is important. Since the sulfide is not sufficiently generated at low temperature, FeS or the like is generated, the steel is embrittled, and the required amount of MnS cannot be secured. Therefore, the temperature (holding temperature) needs to be 1250° C. or more. On the other hand, if the holding temperature is more than 1320° C., since the refractory in the industrial furnace is severely damaged and the heat treatment is difficult to stabilize, the holding temperature needs to be 1320° C. or less.

In order to sufficiently dissolve the compounds, a holding time (soaking time) needs to be 3 minutes or more after reaching the temperature, and it is preferable that the holding time be 10 minutes or more. Particularly, in order to stably exhibit the effects, industrially, it is more preferable that the holding time be 20 minutes or more. In addition, when a large amount of alloy elements are contained or it is necessary to dissolve the alloy elements at a high temperature, the holding time is preferably as long as possible. However, if the holding time is more than 180 minutes, since damages to the material surface increases and damages to the refractory also increases, the holding time needs to be 180 minutes or less, and industrially, it is preferable that the holding time be 120 minutes or less.

Moreover, also in a so-called rolling of product (hot forming and hot rolling) in which the billet is rolled to a product diameter, if the heating temperature is less than 1150° C., Ti-based precipitates, Nb-based precipitates, and AlN cannot be dissolved in the steel, and coarse Ti-based precipitates, coarse Nb-based precipitates, and coarse AlN remain in the steel. In order to disperse fine Ti-based precipitates and Nb-based precipitates in the case hardening steel after the hot forming and suppress generation of the coarse grains during the carburizing and quenching, the heating temperature needs to be 1150° C. or more. The lower limit of appropriate heating temperature is 1180° C. If the heating temperature is more than 1320° C., since the refractory of the industrial heating furnace is severely damaged and it is difficult to perform the heat treatment in a stable manner, it is important that the heating temperature be 1320° C. or less. Considering load on the heating furnace, it is preferable that the temperature of the heating furnace be 1300° C. or less. In order to uniformly hold the temperature of the steel and dissolve precipitates in the steel, it is preferable that the holding time in rolling of the product be 10 minutes or more. From the standpoint of productivity, it is preferable that the holding time be 60 minutes or less.

If a finishing temperature of the hot forming is less than 840° C., crystal grains of ferrite become fine, and coarse grains are easily generated during the carburizing and quenching. If the finishing temperature is more than 1000° C., the steel is hardened and cold formability is deteriorated. Therefore, the finishing temperature of the hot forming is controlled to 840° C. to 1000° C. Moreover, a preferable range of the finishing temperature is 900° C. to 970° C., and a more preferable range of the finishing temperature is 920° C. to 950° C.

In order to finely disperse the Ti-based precipitates and the Nb-based precipitates, cooling conditions after the hot forming are important. The temperature range in which the precipitation of the Ti-based precipitates and the Nb-based precipitates is promoted is 500° C. to 800° C. Therefore, the steel is gradually cooled at an average cooling rate of 1° C./second or less in the temperature range from 800° C. to 500° C., and generation of the Ti-based precipitates and the Nb-based precipitates is promoted. If the average cooling rate is more than 1° C./second, the time in which the steel passes through the precipitation temperature range of the Ti-based precipitates and the Nb-based precipitates is decreased, and the amount of fine precipitates is insufficient. Moreover, if the average cooling rate increases, the ratio of bainite increases in the microstructure. In addition, if the average cooling rate increases, since the case hardening steel is hardened and cold formability is deteriorated, it is preferable that the average cooling rate be 0.7° C./second or less. Moreover, as the method which decreases the average cooling rate, there is a method in which a heat insulation cover or a heat insulation cover having a heat source is disposed behind (downstream of) the rolling line and slow cooling is performed.

Figure 7:
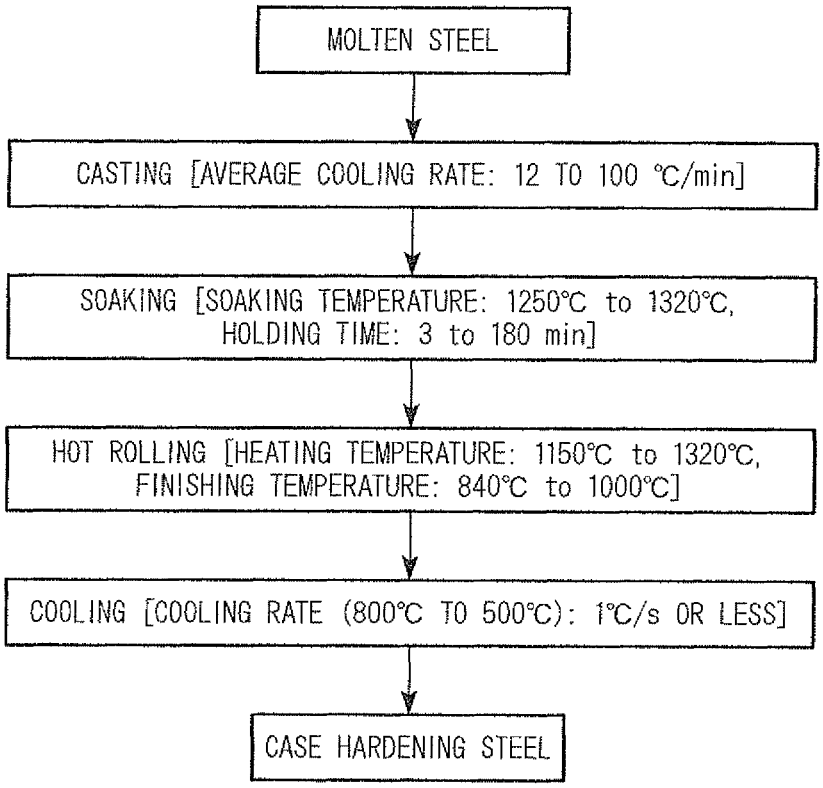
FIG. 7 is a flow chart showing an example of a method of manufacturing the case hardening steel according to an embodiment of the present invention.

Moreover, for reference, FIG. 7 shows a flow chart of an example of a method of manufacturing the case hardening steel according to the embodiment.

[Carburizing]

Next, a method of manufacturing (a method of applying case hardening steel) a carburized part according to an embodiment of the present invention will be described.

The case hardening steel of the embodiment can be applied to either a part which is manufactured in the cold forging process or a part which is manufactured in the hot forging process. For example, as the hot forging process, there is a process of hot forging of a steel bar, heat treatment such as normalizing if necessary, cutting, carburizing and quenching, and grinding if necessary. By using the case hardening steel of the embodiment, for example, hot forging is performed at a heating temperature of 1150° C. or more, thereafter, normalizing is performed if necessary. Therefore, even when high temperature carburizing is performed at a low temperature range of 950° C. to 1090° C., generation of coarse grains can be suppressed. For example, in the case of bearing parts and rotating parts, even when high temperature carburizing is performed, an excellent rolling fatigue characteristics can be obtained.

Conditions of the carburizing and quenching are not particularly limited. In the bearing parts or rotating parts, when a high rolling fatigue lifetime is emphasized, it is preferable that carbon potential be set to 0.8% to 1.3%. In addition, carbonitriding, in which nitriding is performed in the course of diffusion process after the carburizing, is effective in the rolling fatigue lifetime. In this case, a condition in which nitrogen concentration (nitrogen potential) of the surfaces of parts is a range of 0.2% to 0.6% is appropriate. Effects which suppress the microstructure change and the material deterioration at the rolling fatigue process of the bearing parts or the rotating parts by adding Si, Cr, and optional Mo is particularly great when residual austenite (residual γ) in the surface layer of the part after carburizing is 30% to 40%. In order to control the amount of the residual γ of the surface layer of the part to a range of 30% to 40%, carbonitriding is effective. At this time, it is preferable that the carbonitriding be performed so that the nitrogen concentration of the surface layer of the part is a range of 0.2% to 0.6%. By selecting the carbonitriding conditions, a large amount of fine Ti (C, N) is precipitated in the carburized layer and the rolling fatigue lifetime is improved.

Examples

Hereinafter, the present invention will be described in detail based on examples.

Steels including chemical compositions shown in Tables 1 to 3 were prepared as molten steel in a vacuum melting furnace and cast by the average solidification rate of 12 to 20° C./min excluding Nos. 54 to 56. Blanks in chemical components of Tables 1 to 3 mean that the chemical components are not intentionally added, and underlines mean that the conditions of the chemical components of the present invention are not satisfied. In addition, the balance of the chemical components shown in Tables 1 to 3 is iron (Fe) and inevitable impurities. Solidification cooling rate of the bloom was previously adjusted based on data which establish relationships between the cooling conditions and the solidification cooling rate when blooms having various sizes were cast. It was confirmed that the solidification cooling rate in the actual bloom was within a range of 12 to 20° C./min by the secondary arm spacing of dendrite. The confirmed positions are shown in FIG. 3. Billeting was performed to some of the blooms if necessary.

In Tables 4 to 6, maximum equivalent circle diameters (maximum size and maximum diameter) D of the sulfides in the steel, density d of sulfides more than 0.5 μm (number density), and maximum equivalent circle diameters of Ti-based precipitates (maximum size and maximum diameter) are shown. Here, underlines in Tables 4 to 6 mean that the conditions of the density d of the sulfide of the present invention are not satisfied. The maximum equivalent circle diameters of the Ti-based precipitates and the maximum equivalent circle diameters D of the sulfides were predicted by an extreme value statistic method. That is, the maximum diameters of the Ti-based precipitates, grain diameter distributions and maximum diameters of the sulfides were obtained by the following. Microstructures of the steel were observed by an optical microscope, and the precipitates were determined from contrast in the microstructures. In addition, precipitates were identified by using a scanning electron microscope and an energy dispersive X-ray spectroscopic analyzer (EDS). From a cross-section including a longitudinal direction of a test piece described below, 10 ground test pieces each having length 10 mm×width 10 mm were manufactured, predetermined positions of the ground test pieces were photographed at a magnification of 100 times by an optical microscope, 10 fields of view each having an image of a measurement reference area (region) of 0.9 $mm^2$ were prepared. The distribution in the grain size and the maximum diameter of the sulfides, and the maximum diameter of the Ti-based precipitates were detected in the observed fields of view (image). These sizes (diameter) were converted to the equivalent circle diameter which indicated a diameter of a circle having the same area as the area of precipitate.

TABLE 1

| | | Chemical component mass % | | | | | | | | | | | | | | |
|---|---|---|---|---|---|---|---|---|---|---|---|---|---|---|---|---|
| | No. | C | Si | Mn | P | S | Cr | Ti | Nb | Mo | Ni | V | B | Al | N | O |
| Example | 1 | 0.19 | 0.22 | 0.96 | 0.025 | 0.017 | 1.28 | 0.12 | | | | | | 0.026 | 0.0028 | 0.0013 |
| | 2 | 0.21 | 0.24 | 0.43 | 0.020 | 0.015 | 1.14 | 0.10 | | | | | | 0.014 | 0.0029 | 0.0010 |
| | 3 | 0.40 | 0.19 | 1.01 | 0.019 | 0.014 | 1.10 | 0.10 | | | | | | 0.040 | 0.0038 | 0.0011 |
| | 4 | 0.19 | 0.19 | 0.66 | 0.016 | 0.013 | 1.08 | 0.07 | | 0.05 | | | | 0.026 | 0.0036 | 0.0011 |
| | 5 | 0.21 | 0.23 | 1.18 | 0.006 | 0.010 | 1.08 | 0.11 | | | 0.3 | | | 0.014 | 0.0030 | 0.0012 |
| | 6 | 0.18 | 0.22 | 0.66 | 0.013 | 0.015 | 1.18 | 0.12 | | | | 0.16 | | 0.031 | 0.0044 | 0.0011 |
| | 7 | 0.20 | 0.24 | 0.34 | 0.024 | 0.016 | 1.30 | 0.09 | | | | | 0.0016 | 0.038 | 0.0029 | 0.0014 |
| | 8 | 0.18 | 0.24 | 0.99 | 0.020 | 0.040 | 1.26 | 0.11 | | | | | | 0.015 | 0.0035 | 0.0015 |
| | 9 | 0.38 | 0.23 | 1.22 | 0.025 | 0.028 | 1.20 | 0.14 | | | | | | 0.041 | 0.0041 | 0.0014 |
| | 10 | 0.22 | 0.21 | 0.41 | 0.011 | 0.040 | 1.13 | 0.12 | | 0.07 | | | | 0.014 | 0.0047 | 0.0014 |
| | 11 | 0.19 | 0.19 | 1.71 | 0.020 | 0.031 | 1.23 | 0.07 | | | 0.21 | | | 0.006 | 0.0046 | 0.0012 |
| | 12 | 0.20 | 0.23 | 1.44 | 0.023 | 0.040 | 1.18 | 0.05 | | | | 0.21 | | 0.030 | 0.0033 | 0.0013 |
| | 13 | 0.20 | 0.35 | 1.08 | 0.008 | 0.029 | 1.17 | 0.10 | | | | | 0.0021 | 0.022 | 0.0045 | 0.0014 |
| | 14 | 0.21 | 0.18 | 0.52 | 0.014 | 0.072 | 1.29 | 0.13 | | | | | | 0.018 | 0.0039 | 0.0012 |
| | 15 | 0.19 | 0.22 | 1.80 | 0.024 | 0.090 | 1.26 | 0.14 | | | | | | 0.033 | 0.0030 | 0.0012 |
| | 16 | 0.19 | 0.20 | 0.86 | 0.022 | 0.110 | 1.18 | 0.13 | | | | | | 0.120 | 0.0032 | 0.0014 |
| | 17 | 0.20 | 0.21 | 0.51 | 0.016 | 0.012 | 1.28 | 0.08 | 0.006 | | | | | 0.041 | 0.0025 | 0.0012 |
| | 18 | 0.18 | 0.23 | 0.34 | 0.010 | 0.013 | 1.18 | 0.12 | 0.022 | | | | | 0.025 | 0.0048 | 0.0015 |
| | 19 | 0.20 | 0.34 | 1.67 | 0.012 | 0.012 | 1.14 | 0.06 | 0.021 | 0.28 | | | | 0.011 | 0.0048 | 0.0011 |
| | 20 | 0.21 | 0.21 | 0.91 | 0.022 | 0.014 | 1.23 | 0.06 | 0.015 | | | 0.13 | | 0.036 | 0.0043 | 0.0014 |
| | 21 | 0.21 | 0.23 | 1.58 | 0.020 | 0.015 | 1.14 | 0.14 | 0.009 | | 0.30 | | | 0.020 | 0.0029 | 0.0010 |
| | 22 | 0.18 | 0.24 | 0.95 | 0.023 | 0.013 | 1.28 | 0.11 | 0.016 | | | | | 0.020 | 0.0039 | 0.0013 |

TABLE 2

| | | Chemical component mass % | | | | | | | | | | | | | | |
|---|---|---|---|---|---|---|---|---|---|---|---|---|---|---|---|---|
| | No. | C | Si | Mn | P | S | Cr | Ti | Nb | Mo | Ni | V | B | Al | N | O |
| Example | 23 | 0.20 | 0.25 | 0.71 | 0.020 | 0.017 | 1.20 | 0.12 | 0.010 | | | | 0.0015 | 0.026 | 0.0027 | 0.0012 |
| | 24 | 0.21 | 0.21 | 1.73 | 0.013 | 0.013 | 1.06 | 0.06 | 0.019 | | | | | 0.091 | 0.0043 | 0.0012 |
| | 25 | 0.20 | 0.21 | 1.27 | 0.023 | 0.028 | 1.19 | 0.09 | 0.022 | | | | | 0.022 | 0.0034 | 0.0014 |
| | 26 | 0.21 | 0.21 | 0.64 | 0.016 | 0.036 | 1.24 | 0.09 | 0.013 | | | | | 0.046 | 0.0039 | 0.0015 |
| | 27 | 0.20 | 0.24 | 1.08 | 0.018 | 0.028 | 1.10 | 0.11 | 0.007 | | | | | 0.086 | 0.0040 | 0.0013 |
| | 28 | 0.39 | 0.21 | 0.31 | 0.014 | 0.040 | 1.21 | 0.13 | 0.009 | | | | | 0.033 | 0.0038 | 0.0010 |
| | 29 | 0.18 | 0.19 | 0.55 | 0.020 | 0.034 | 1.24 | 0.15 | 0.015 | | | | | 0.029 | 0.0043 | 0.0011 |
| | 30 | 0.20 | 0.21 | 1.28 | 0.008 | 0.078 | 1.27 | 0.07 | 0.005 | | | | | 0.011 | 0.0035 | 0.0012 |
| | 31 | 0.19 | 0.21 | 1.40 | 0.025 | 0.098 | 1.22 | 0.13 | 0.013 | | | | | 0.014 | 0.0047 | 0.0011 |
| | 32 | 0.21 | 0.22 | 0.61 | 0.006 | 0.105 | 1.11 | 0.13 | 0.008 | 0.06 | | | | 0.011 | 0.0035 | 0.0012 |
| | 33 | 0.20 | 0.25 | 1.33 | 0.009 | 0.087 | 1.07 | 0.11 | 0.019 | | | 0.21 | | 0.010 | 0.0035 | 0.0013 |
| | 34 | 0.21 | 0.22 | 1.49 | 0.018 | 0.086 | 1.23 | 0.12 | 0.005 | | 0.45 | | | 0.026 | 0.0038 | 0.0014 |
| | 35 | 0.21 | 0.22 | 0.50 | 0.020 | 0.105 | 1.19 | 0.05 | 0.009 | | | | 0.0016 | 0.035 | 0.0049 | 0.0015 |
| | 36 | 0.19 | 0.19 | 0.41 | 0.018 | 0.017 | 1.13 | 0.13 | | 0.15 | | | | 0.010 | 0.0044 | 0.0013 |
| | 37 | 0.40 | 0.23 | 0.35 | 0.018 | 0.013 | 1.27 | 0.09 | | 0.18 | | | | 0.040 | 0.0026 | 0.0013 |
| | 38 | 0.19 | 0.19 | 1.67 | 0.012 | 0.018 | 1.23 | 0.10 | | 0.14 | | | | 0.035 | 0.0044 | 0.0012 |
| | 39 | 0.21 | 0.25 | 1.42 | 0.008 | 0.037 | 1.25 | 0.13 | | 0.16 | | | | 0.011 | 0.0033 | 0.0010 |
| | 40 | 0.41 | 0.20 | 0.36 | 0.011 | 0.032 | 1.25 | 0.09 | | 0.25 | | | | 0.032 | 0.0037 | 0.0012 |
| | 41 | 0.20 | 0.21 | 1.22 | 0.009 | 0.034 | 1.18 | 0.14 | 0.015 | 0.14 | | | | 0.007 | 0.0032 | 0.0012 |
| | 42 | 0.21 | 0.18 | 1.41 | 0.008 | 0.044 | 1.19 | 0.14 | 0.006 | 0.13 | | | | 0.018 | 0.0050 | 0.0012 |
| | 43 | 0.21 | 0.22 | 0.49 | 0.011 | 0.102 | 1.16 | 0.12 | 0.023 | 0.13 | | | | 0.043 | 0.0035 | 0.0015 |
| | 44 | 0.21 | 0.23 | 1.62 | 0.022 | 0.112 | 1.27 | 0.09 | 0.018 | 0.14 | | | | 0.035 | 0.0045 | 0.0013 |
| | 45 | 0.21 | 0.20 | 1.74 | 0.021 | 0.013 | 0.76 | 0.12 | | | | | | 0.037 | 0.0046 | 0.0013 |
| | 46 | 0.20 | 0.20 | 0.95 | 0.007 | 0.015 | 1.52 | 0.08 | | | | | | 0.040 | 0.0050 | 0.0010 |
| | 47 | 0.18 | 1.12 | 1.02 | 0.014 | 0.012 | 1.12 | 0.08 | | | | | | 0.034 | 0.0046 | 0.0010 |

TABLE 3

| | | Chemical component mass % | | | | | | | | | | | | | | |
|---|---|---|---|---|---|---|---|---|---|---|---|---|---|---|---|---|
| | No | C | Si | Mn | P | S | Cr | Ti | Nb | Mo | Ni | V | B | Al | N | O |
| Comparative Example | 48 | 0.20 | 0.21 | 1.38 | 0.021 | 0.018 | 1.18 | — | | | | | | 0.035 | 0.0126 | 0.0011 |
| | 49 | 0.21 | 0.24 | 0.76 | 0.011 | 0.045 | 1.11 | — | | | | | | 0.036 | 0.0110 | 0.0014 |
| | 50 | 0.19 | 0.25 | 0.69 | 0.009 | 0.087 | 1.08 | — | | | | | | 0.034 | 0.0121 | 0.0010 |
| | 51 | 0.20 | 0.20 | 0.39 | 0.009 | 0.015 | 1.13 | — | | 0.12 | | | | 0.036 | 0.0141 | 0.0013 |
| | 52 | 0.22 | 0.18 | 0.76 | 0.012 | 0.051 | 1.06 | — | | 0.14 | | | | 0.038 | 0.0109 | 0.0014 |
| | 53 | 0.18 | 0.26 | 0.80 | 0.016 | 0.112 | 1.10 | — | | 0.15 | | | | 0.035 | 0.0125 | 0.0016 |
| | 54 | 0.21 | 0.24 | 0.58 | 0.024 | 0.011 | 1.29 | 0.12 | | | | | | 0.020 | 0.0043 | 0.0012 |
| | 55 | 0.22 | 0.20 | 0.74 | 0.008 | 0.052 | 1.09 | 0.09 | | | | | | 0.007 | 0.0026 | 0.0015 |
| | 56 | 0.20 | 0.25 | 0.99 | 0.022 | 0.092 | 1.17 | 0.13 | | | | | | 0.006 | 0.0028 | 0.0014 |
| | 57 | 0.20 | 0.18 | 1.11 | 0.008 | 0.031 | 1.15 | 0.11 | | | | | | 0.014 | 0.0029 | 0.0012 |
| | 58 | 0.22 | 0.22 | 0.84 | 0.014 | 0.035 | 1.07 | 0.05 | | | | | | 0.038 | 0.0047 | 0.0015 |
| | 59 | 0.19 | 0.23 | 0.37 | 0.016 | 0.081 | 1.11 | 0.11 | | | | | | 0.020 | 0.0030 | 0.0011 |
| | 60 | 0.21 | 0.23 | 1.39 | 0.025 | 0.018 | 1.15 | 0.04 | | | | | | 0.037 | 0.0048 | 0.0010 |
| | 61 | 0.21 | 0.19 | 1.75 | 0.013 | 0.043 | 1.06 | 0.03 | | | | | | 0.029 | 0.0027 | 0.0012 |
| | 62 | 0.20 | 0.19 | 1.20 | 0.015 | 0.084 | 1.05 | 0.02 | | | | | | 0.017 | 0.0026 | 0.0011 |
| | 63 | 0.21 | 0.20 | 1.57 | 0.025 | 0.013 | 1.18 | 0.13 | | | | | | 0.012 | 0.0128 | 0.0013 |
| | 64 | 0.19 | 0.23 | 0.57 | 0.024 | 0.051 | 1.28 | 0.09 | | | | | | 0.036 | 0.0132 | 0.0011 |
| | 65 | 0.19 | 0.22 | 0.58 | 0.021 | 0.094 | 1.22 | 0.08 | | | | | | 0.044 | 0.0099 | 0.0012 |
| | 66 | 0.39 | 0.35 | 0.78 | 0.022 | 0.011 | 1.12 | 0.11 | | | | | | 0.036 | 0.0045 | 0.0012 |
| | 67 | 0.41 | 0.22 | 1.02 | 0.019 | 0.045 | 1.16 | 0.09 | | | | | | 0.031 | 0.0042 | 0.0011 |
| | 68 | 0.40 | 0.30 | 1.12 | 0.017 | 0.088 | 1.27 | 0.08 | | | | | | 0.023 | 0.0038 | 0.0012 |
| | 69 | 0.41 | 0.21 | 0.76 | 0.014 | 0.014 | 1.07 | 0.14 | 0.023 | | | | | 0.023 | 0.0048 | 0.0015 |
| | 70 | 0.38 | 0.23 | 0.98 | 0.020 | 0.045 | 1.13 | 0.07 | 0.020 | | | | | 0.036 | 0.0028 | 0.0014 |
| | 71 | 0.39 | 0.23 | 1.37 | 0.011 | 0.084 | 1.06 | 0.07 | 0.012 | | | | | 0.027 | 0.0034 | 0.0015 |
| | 72 | 0.21 | 0.19 | 1.77 | 0.019 | 0.018 | 1.11 | 0.08 | 0.050 | | | | | 0.018 | 0.0041 | 0.0014 |
| | 73 | 0.19 | 0.22 | 1.67 | 0.021 | 0.045 | 1.09 | 0.09 | 0.042 | | | | | 0.035 | 0.0031 | 0.0014 |
| | 74 | 0.21 | 0.22 | 0.42 | 0.023 | 0.080 | 1.25 | 0.09 | 0.052 | | | | | 0.024 | 0.0049 | 0.0011 |
| | 75 | 0.18 | 0.19 | 1.79 | 0.008 | 0.021 | 1.06 | 0.02 | | | | | | 0.041 | 0.0041 | 0.0012 |
| | 76 | 0.18 | 0.19 | 1.69 | 0.011 | 0.051 | 1.19 | 0.03 | | | | | | 0.025 | 0.0038 | 0.0012 |
| | 77 | 0.21 | 0.23 | 1.49 | 0.007 | 0.079 | 1.14 | 0.01 | | | | | | 0.008 | 0.0029 | 0.0014 |
| | 78 | 0.19 | 0.25 | 1.52 | 0.009 | 0.012 | 1.27 | 0.04 | | | | | | 0.011 | 0.0027 | 0.0015 |
| | 79 | 0.20 | 0.19 | 1.37 | 0.007 | 0.016 | 1.20 | 0.30 | | | | | | 0.032 | 0.0035 | 0.0015 |

TABLE 4

| | | Maximum equivalent circle diameter of sulfide D | | Density of sulfide more than 5 μm d | | Maximum equivalent circle diameter |
|---|---|---|---|---|---|---|
| | No. | Measured value (μm) | 250 × [S] + 10 (μm) | Measured value (particles/mm$^2$) | 500 × [S] + 1 (particles/mm$^2$) | of Ti-based precipitates (μm) |
| Example | 1 | 7 | 14 | 2.9 | 9.5 | 20 |
| | 2 | 7 | 14 | 1.3 | 8.3 | 23 |
| | 3 | 8 | 13 | 2.3 | 7.8 | 29 |
| | 4 | 7 | 13 | 1.9 | 7.4 | 31 |
| | 5 | 7 | 13 | 1.9 | 6.2 | 28 |
| | 6 | 7 | 14 | 2.7 | 8.5 | 27 |
| | 7 | 8 | 14 | 1.2 | 9.2 | 20 |
| | 8 | 10 | 20 | 12.1 | 21.0 | 29 |
| | 9 | 9 | 17 | 6.9 | 15.1 | 21 |
| | 10 | 10 | 20 | 12.8 | 20.8 | 23 |
| | 11 | 9 | 18 | 8.3 | 16.7 | 23 |
| | 12 | 11 | 20 | 12.3 | 21.1 | 28 |
| | 13 | 9 | 17 | 8.0 | 15.5 | 31 |
| | 14 | 16 | 28 | 28.3 | 37.0 | 22 |
| | 15 | 18 | 33 | 36.1 | 46.0 | 21 |
| | 16 | 22 | 38 | 45.3 | 46.0 | 28 |
| | 17 | 8 | 13 | 0.7 | 7.1 | 26 |
| | 18 | 8 | 13 | 1.4 | 7.5 | 31 |
| | 19 | 7 | 13 | 2.1 | 6.9 | 21 |
| | 20 | 8 | 14 | 2.0 | 8.0 | 30 |
| | 21 | 7 | 14 | 2.1 | 8.4 | 25 |
| | 22 | 6 | 13 | 1.1 | 7.7 | 21 |

TABLE 5

| | No. | Maximum equivalent circle diameter of sulfide D: Measured value (μm) | Maximum equivalent circle diameter of sulfide D: 250 × [S] + 10 (μm) | Density of sulfide more than 5 μm d: Measured value (particles/mm$^2$) | Density of sulfide more than 5 μm d: 500 × [S] + 1 (particles/mm$^2$) | Maximum equivalent circle diameter of Ti-based precipitates (μm) |
|---|---|---|---|---|---|---|
| Example | 23 | 8 | 14 | 1.5 | 9.7 | 25 |
| | 24 | 8 | 13 | 2.5 | 7.5 | 24 |
| | 25 | 10 | 17 | 6.7 | 15.2 | 29 |
| | 26 | 11 | 19 | 10.5 | 19.1 | 26 |
| | 27 | 10 | 17 | 6.9 | 15.2 | 21 |
| | 28 | 11 | 20 | 13.7 | 20.8 | 24 |
| | 29 | 10 | 19 | 9.3 | 18.1 | 21 |
| | 30 | 16 | 30 | 31.5 | 40.0 | 21 |
| | 31 | 19 | 35 | 39.7 | 50.0 | 29 |
| | 32 | 21 | 36 | 44.8 | 53.5 | 27 |
| | 33 | 18 | 32 | 35.4 | 44.5 | 25 |
| | 34 | 19 | 32 | 34.4 | 44.0 | 24 |
| | 35 | 20 | 36 | 43.3 | 53.5 | 27 |
| | 36 | 7 | 14 | 2.3 | 9.4 | 28 |
| | 37 | 7 | 13 | 0.8 | 7.7 | 22 |
| | 38 | 7 | 14 | 2.5 | 9.8 | 23 |
| | 39 | 10 | 19 | 11.7 | 19.5 | 20 |
| | 40 | 9 | 18 | 8.6 | 16.8 | 29 |
| | 41 | 11 | 18 | 10.4 | 17.9 | 29 |
| | 42 | 12 | 21 | 15.3 | 22.9 | 23 |
| | 43 | 21 | 36 | 41.6 | 52.0 | 32 |
| | 44 | 21 | 38 | 47.0 | 57.0 | 30 |
| | 45 | 10 | 13 | 0.4 | 7.5 | 26 |
| | 46 | 9 | 14 | 0.4 | 8.5 | 28 |
| | 47 | 8 | 13 | 1.7 | 6.9 | 31 |

TABLE 6

| | No. | Maximum equivalent circle diameter of sulfide D: Measured value (μm) | Maximum equivalent circle diameter of sulfide D: 250 × [S] + 10 (μm) | Density of sulfide more than 5 μm d: Measured value (particles/mm$^2$) | Density of sulfide more than 5 μm d: 500 × [S] + 1 (particles/mm$^2$) | Maximum equivalent circle diameter of Ti-based precipitates (μm) |
|---|---|---|---|---|---|---|
| Comparative Example | 48 | 20 | 14 | 11.9 | 9.8 | — |
| | 49 | 27 | 21 | 24.6 | 23.5 | — |
| | 50 | 37 | 32 | 47.5 | 44.5 | — |
| | 51 | 20 | 14 | 9.5 | 8.6 | — |
| | 52 | 28 | 23 | 29.1 | 26.5 | — |
| | 53 | 45 | 38 | 49.3 | 57.0 | — |
| | 54 | 18 | 13 | 7.3 | 6.5 | 29 |
| | 55 | 28 | 23 | 28.8 | 27.0 | 27 |
| | 56 | 38 | 33 | 50.1 | 47.0 | 25 |
| | 57 | 14 | 18 | 18.2 | 16.6 | 21 |
| | 58 | 11 | 19 | 19.5 | 18.6 | 24 |
| | 59 | 11 | 30 | 44.5 | 41.7 | 29 |
| | 60 | 8 | 15 | 1.7 | 10.0 | 28 |
| | 61 | 11 | 21 | 14.7 | 22.5 | 31 |
| | 62 | 19 | 31 | 34.8 | 43.0 | 35 |
| | 63 | 7 | 13 | 3.3 | 7.5 | 55 |
| | 64 | 13 | 23 | 20.9 | 26.5 | 52 |
| | 65 | 18 | 33 | 42.0 | 48.0 | 53 |
| | 66 | 19 | 13 | 8.6 | 6.5 | 30 |
| | 67 | 27 | 21 | 25.7 | 23.5 | 32 |
| | 68 | 37 | 32 | 48.2 | 45.0 | 34 |
| | 69 | 19 | 13 | 8.7 | 7.8 | 29 |
| | 70 | 26 | 21 | 25.2 | 23.7 | 30 |
| | 71 | 37 | 31 | 45.9 | 43.1 | 31 |
| | 72 | 9 | 14 | 1.7 | 9.8 | 30 |
| | 73 | 12 | 21 | 15.5 | 23.5 | 23 |
| | 74 | 17 | 30 | 32.8 | 41.0 | 28 |
| | 75 | 9 | 15 | 1.8 | 11.5 | 25 |
| | 76 | 13 | 23 | 17.6 | 26.5 | 29 |
| | 77 | 16 | 30 | 32.8 | 40.5 | 22 |
| | 78 | 7 | 13 | 0.7 | 6.8 | 33 |
| | 79 | 8 | 14 | 1.4 | 9.0 | 76 |

Next, steel bars having diameters of 24 mm to 30 mm were manufactured by performing hot forming. A micro-observation of the steel bars was performed, the ratio of bainite was measured, and the grain size number of ferrite based on the definition of JIS G 0551 was measured. In addition, Vickers hardness was measured based on JIS Z 2244 (2003), and the hardness was used as an index of cold formability or machinability. In Tables 7 to 9, heating temperatures of hot forming, finishing temperatures, average cooling rates, ratios of bainite, grain size numbers of ferrite, and Vickers hardness are shown. In addition, the average cooling rates are cooling rates in a range of 500° C. to 800° C. and obtained from the time which was required to cool from 800° C. to 500° C. Here, the underlines in Tables 7 to 9 mean that the manufacturing conditions of the present invention are not satisfied.

Figure 4:
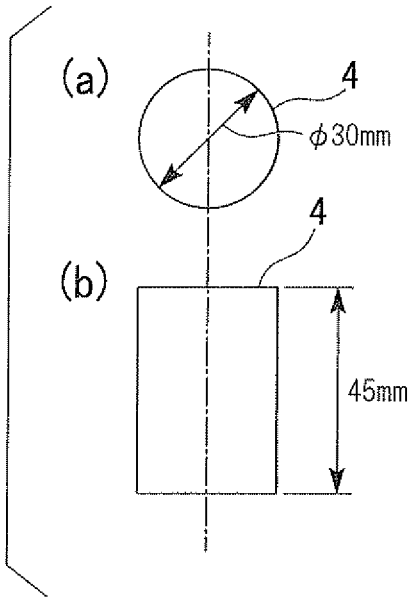
FIG. 4 is a diagram of a test piece which is used in an upsetting test in which hot forging is assumed.
Figure 5:
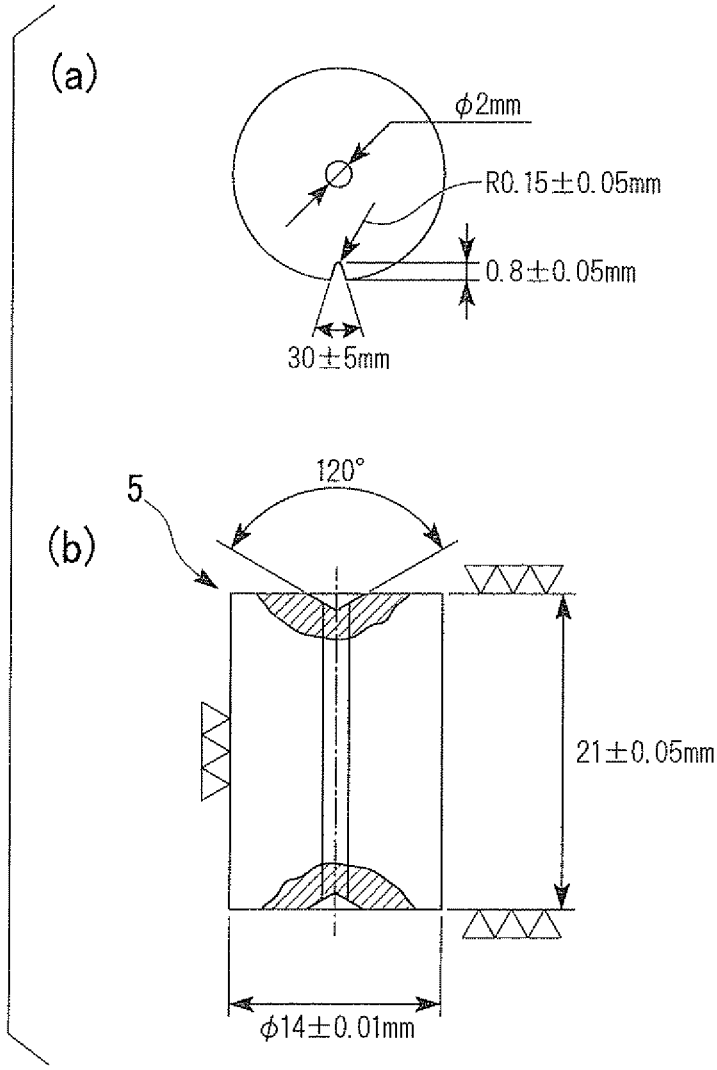
FIG. 5 is a diagram of a test piece which is used in an upsetting test in which cold forging is assumed.

The hot forgeability and cold forgeability were evaluated by an upsetting test. In order to estimate hot forgeability, a test piece 4 shown in FIG. 4 having a bottom surface of ϕ30 mm and a height of 45 mm was heated up to 1250° C. and thereafter, was upset. In addition, compressibility (limiting compressibility) in which cracks were generated was measured. In addition, a chain line in FIG. 4 indicates a center line common to (a) and (b). In order to estimate cold forgeability, after spheroidizing annealing was performed on the steel, a grooved test piece 5 having a size shown in FIG. 5 was sampled, an upsetting test was performed, and the limiting compressibility was measured until cracks were generated. A probability of the crack generation was obtained with respect to various compressibility values using 10 test pieces, the compressibility when the probability became 50% was determined as the limiting compressibility. It is estimated that forgeability is further improved as the limiting compressibility increases. The present test is an estimation method close to the cold forging. However, the present test can be also used as an index which indicates influences of the sulfide with respect to forgeability in the hot forging.

With respect to machinability, a test determining the length of lifespan to breakage of a drill was performed and the machinability was estimated. In the heat treatment performed in advance, the steel was heated up to 1250° C. while assuming hot forging and the steel was cooled at a predetermined cooling rate. In estimation of the machinability, by using a high-speed steel straight drill having a diameter of 3 mm and a water-soluble cutting oil, drilling was performed under a condition of a feed of 0.25 mm, a drilling depth of 9 mm, and a projection length of the drill of 35 mm. A circumferential speed of the drill was constantly controlled within a range of 10 to 70 m/min, the steel was drilled, and a cumulative drilling depth up to breakage of the drill was measured. Here, the cumulative drilling depth is the product of a depth of single hole and the number of holes formed by drilling. The circumferential speed of the drill was changed and the similar measurement was performed. Among the circumferential speed of the drill in which the cumulative drilling depth was more than 1000 mm, the maximum value of the circumferential speed of the drill was obtained as $VL_{1000}$. As the $VL_{1000}$ increases, the tool life is improved, and the steel can be estimated as the material having an excellent machinability.

Test pieces was sampled from steel bars which were heated up to 1250° C. while assuming hot forging, a heat treatment (referred to as carburizing simulation) simulating the carburizing and quenching was performed after cold upsetting forging of 50% of reduction was performed, and characteristics preventing coarse grains was estimated by measuring a grain size of prior austenite. The carburizing simulation is a heat treatment in which the test piece is heated to 910° C. to 1060° C., held for five hours, and cooled by water. A grain size of prior austenite was measured based on JIS G 0551 (2005).

In addition, the grain size of prior austenite was measured, and a temperature (coarsening temperature) at which the coarse grains were generated was obtained. In addition, the grain size of prior austenite was measured by performing observation of cross-sections of test pieces of about 10 fields of view at a magnification of 400 times, and if at least one coarse grain having the grain size number of 5 or less is present, the test result of the test piece was determined as generation of coarse grains, and the coarsening temperature was determined. In general, since the heating temperature of the carburizing and quenching is 930° C. to 950° C., the test piece in which the coarsening temperature is 950° C. or less was determined to be deteriorated in characteristics of preventing coarsening.

Next, cold forging of 50% of the reduction was performed, and thereafter, a normalizing was skipped, columnar test pieces of rolling fatigue having a diameter of 12.2 mm were sampled and carburizing and quenching was performed on the sampled test pieces. In the carburizing and quenching, the test piece was heated to 950° C. in carburizing atmosphere having a carbon potential of 0.8%, was kept during 5 hours, and quenched in oil in which the temperature was 130° C. In addition, the test piece was kept during 2 hours at 180° C., and tempering was performed. With respect to the test piece (carburized and quenched material), γ grain size of carburized layer (austenite grain size number of carburized layer) was investigated based on JIS G 0551. Moreover, rolling fatigue characteristics were estimated using a point contact type rolling fatigue tester (Hertzian maximum contact stress of 5884 MPa). As a measure of the fatigue life, $L_{10}$ life, which was defined as "the number of stress cycles to the fatigue fracture in the cumulative damage probability of 10% obtained by plotting test results on Weibull probability paper", was used. However, with respect to the materials in which cracks were frequently generated in the reduction of 50%, the subsequent fatigue test was not performed.

The investigation results were collected and are shown in Tables 7 to 9. In the rolling fatigue life, $L_{10}$ life of No. 48 (Comparative Example) was defined as 1, $L_{10}$ life of each material (each No.) was estimated by a relative value with respect to $L_{10}$ life of No. 48.

In the fatigue test, in each case, normalizing prior to the carburizing was skipped, and the same processing conditions having a high carburizing temperature at which the carburizing could be relatively efficiently performed were adopted. Thereby, in Nos. 1 to 47 (Examples), the carburizing could be efficiently performed, and good fatigue test results could be obtained. On the other hand, in Nos. 48 to 79 (Comparative Example), coarse particles of Ti-based precipitates such as TiN and Ti-based complex sulfide and the sulfide such as MnS acted as a fracture starting point, strain according to generation of the coarse grains (coarse grains of prior austenite) decreased the test accuracy, or the coarse grains (coarse grains of prior austenite) themselves became the fracture starting point. Therefore, good test results were not obtained in some of the tests.

TABLE 7

| | No. | Soaking temperature (° C.) | Soaking time (min) | Hot forming: Heating temperature (° C.) | Hot forming: Finishing temperature (° C.) | Hot forming: Average cooling rate (° C./s) | Ratio of bainite (%) | Ferrite grain size number (—) | Hardness in hot rolling HV (HV) | Limiting compressibility: Hot (%) | Limiting compressibility: Cold (%) | Machinability $VL_{1000}$ (m/min) | Coarsening temperature in carburizing (° C.) | Fatigue life of carburized material (Relative value) (—) |
|---|---|---|---|---|---|---|---|---|---|---|---|---|---|---|
| Example | 1 | 1280 | 20 | 1230 | 940 | 0.52 | 0 | 9 | 181 | 91 | 58 | 48 | 1050 | 3.3 |
| | 2 | 1280 | 20 | 1260 | 930 | 0.51 | 0 | 9 | 178 | 93 | 59 | 44 | 1050 | 3.4 |
| | 3 | 1280 | 20 | 1260 | 940 | 0.45 | 6 | 8 | 216 | 92 | 52 | 40 | 1050 | 3.3 |
| | 4 | 1280 | 20 | 1260 | 940 | 0.46 | 0 | 10 | 182 | 93 | 60 | 33 | 1050 | 3.7 |
| | 5 | 1280 | 20 | 1240 | 940 | 0.48 | 0 | 10 | 173 | 92 | 59 | 43 | 1050 | 3.3 |
| | 6 | 1280 | 20 | 1230 | 930 | 0.50 | 0 | 9 | 181 | 92 | 59 | 46 | 1050 | 3.3 |
| | 7 | 1280 | 20 | 1220 | 940 | 0.49 | 0 | 10 | 174 | 93 | 59 | 44 | 1050 | 3.2 |
| | 8 | 1280 | 20 | 1250 | 930 | 0.57 | 0 | 10 | 177 | 91 | 57 | 52 | 1060 | 2.8 |
| | 9 | 1280 | 20 | 1230 | 940 | 0.47 | 7 | 10 | 202 | 91 | 50 | 42 | 1060 | 3.1 |
| | 10 | 1280 | 20 | 1270 | 950 | 0.47 | 0 | 11 | 176 | 91 | 56 | 39 | 1060 | 3.0 |
| | 11 | 1280 | 20 | 1230 | 950 | 0.48 | 0 | 10 | 180 | 91 | 57 | 50 | 1060 | 2.9 |
| | 12 | 1280 | 20 | 1210 | 950 | 0.50 | 0 | 10 | 182 | 89 | 57 | 50 | 1060 | 2.8 |
| | 13 | 1280 | 20 | 1220 | 940 | 0.51 | 0 | 11 | 178 | 91 | 58 | 51 | 1060 | 3.0 |
| | 14 | 1280 | 20 | 1250 | 950 | 0.55 | 0 | 10 | 184 | 86 | 54 | 57 | 1060 | 2.2 |
| | 15 | 1280 | 20 | 1200 | 940 | 0.48 | 0 | 11 | 183 | 84 | 52 | 61 | 1060 | 1.9 |
| | 16 | 1280 | 20 | 1250 | 950 | 0.56 | 0 | 11 | 175 | 82 | 50 | 75 | 1080 | 1.5 |
| | 17 | 1280 | 30 | 1240 | 950 | 0.53 | 0 | 10 | 175 | 92 | 59 | 45 | 1050 | 3.4 |
| | 18 | 1280 | 30 | 1210 | 950 | 0.51 | 0 | 8 | 171 | 92 | 61 | 46 | 1050 | 3.3 |
| | 19 | 1280 | 30 | 1220 | 940 | 0.25 | 24 | 8 | 182 | 93 | 59 | 33 | 1050 | 3.6 |
| | 20 | 1280 | 30 | 1220 | 930 | 0.49 | 0 | 9 | 184 | 92 | 59 | 48 | 1050 | 3.3 |
| | 21 | 1280 | 30 | 1260 | 940 | 0.54 | 0 | 9 | 174 | 93 | 60 | 44 | 1050 | 3.4 |
| | 22 | 1280 | 30 | 1210 | 930 | 0.45 | 0 | 9 | 181 | 92 | 61 | 47 | 1050 | 3.3 |

TABLE 8

| | No. | Soaking temperature (° C.) | Soaking time (min) | Hot forming: Heating temperature (° C.) | Hot forming: Finishing temperature (° C.) | Hot forming: Average cooling rate (° C./s) | Ratio of bainite (%) | Ferrite grain size number (—) | Hardness in hot rolling HV (HV) | Limiting compressibility: Hot (%) | Limiting compressibility: Cold (%) | Machinability $VL_{1000}$ (m/min) | Coarsening temperature in carburizing (° C.) | Fatigue life of carburized material (Relative value) (—) |
|---|---|---|---|---|---|---|---|---|---|---|---|---|---|---|
| Example | 23 | 1280 | 30 | 1270 | 930 | 0.52 | 0 | 8 | 181 | 92 | 60 | 48 | 1050 | 3.3 |
| | 24 | 1280 | 30 | 1270 | 940 | 0.50 | 12 | 10 | 174 | 93 | 60 | 60 | 1060 | 3.4 |
| | 25 | 1280 | 30 | 1260 | 930 | 0.49 | 0 | 11 | 176 | 90 | 57 | 49 | 1060 | 3.1 |
| | 26 | 1280 | 30 | 1250 | 940 | 0.47 | 0 | 10 | 182 | 91 | 57 | 51 | 1060 | 2.8 |
| | 27 | 1280 | 30 | 1220 | 930 | 0.49 | 0 | 9 | 182 | 90 | 59 | 65 | 1060 | 3.1 |
| | 28 | 1280 | 30 | 1220 | 940 | 0.51 | 17 | 11 | 201 | 90 | 51 | 42 | 1070 | 2.8 |
| | 29 | 1280 | 30 | 1230 | 930 | 0.48 | 0 | 9 | 179 | 90 | 58 | 50 | 1070 | 2.8 |
| | 30 | 1280 | 30 | 1250 | 950 | 0.51 | 0 | 10 | 181 | 86 | 52 | 60 | 1070 | 1.9 |
| | 31 | 1280 | 30 | 1220 | 950 | 0.54 | 0 | 10 | 175 | 84 | 51 | 62 | 1070 | 1.5 |
| | 32 | 1280 | 30 | 1250 | 950 | 0.56 | 0 | 10 | 175 | 82 | 50 | 55 | 1070 | 2.0 |
| | 33 | 1280 | 30 | 1240 | 950 | 0.46 | 0 | 11 | 184 | 85 | 53 | 58 | 1070 | 1.7 |
| | 34 | 1280 | 30 | 1270 | 940 | 0.54 | 0 | 11 | 184 | 85 | 52 | 59 | 1060 | 1.7 |
| | 35 | 1280 | 30 | 1240 | 950 | 0.47 | 0 | 11 | 174 | 82 | 51 | 66 | 1060 | 1.5 |
| | 36 | 1280 | 30 | 1210 | 940 | 0.57 | 6 | 10 | 191 | 91 | 62 | 33 | 1060 | 3.5 |
| | 37 | 1280 | 30 | 1240 | 940 | 0.48 | 15 | 10 | 211 | 93 | 50 | 20 | 1050 | 3.7 |
| | 38 | 1280 | 30 | 1210 | 930 | 0.53 | 6 | 10 | 187 | 92 | 60 | 30 | 1050 | 3.5 |
| | 39 | 1280 | 30 | 1250 | 940 | 0.50 | 4 | 10 | 194 | 91 | 57 | 36 | 1060 | 3.2 |
| | 40 | 1280 | 30 | 1220 | 950 | 0.52 | 25 | 9 | 227 | 90 | 48 | 21 | 1060 | 3.5 |
| | 41 | 1280 | 30 | 1230 | 950 | 0.46 | 5 | 10 | 185 | 90 | 57 | 34 | 1060 | 3.4 |
| | 42 | 1280 | 30 | 1250 | 950 | 0.50 | 4 | 10 | 188 | 88 | 57 | 35 | 1060 | 3.2 |
| | 43 | 1280 | 30 | 1210 | 940 | 0.54 | 8 | 11 | 186 | 83 | 52 | 47 | 1070 | 2.2 |
| | 44 | 1280 | 30 | 1220 | 950 | 0.52 | 3 | 11 | 195 | 82 | 50 | 52 | 1050 | 2.0 |
| | 45 | 1280 | 30 | 1250 | 950 | 0.56 | 0 | 9.9 | 195 | 93 | 62 | 48 | 1080 | 3.1 |
| | 46 | 1280 | 30 | 1240 | 940 | 0.48 | 0 | 10.2 | 181 | 93 | 64 | 49 | 1060 | 3.6 |
| | 47 | 1280 | 30 | 1230 | 950 | 0.52 | 0 | 9.9 | 186 | 93 | 63 | 49 | 1060 | 3.4 |

TABLE 9

| | No. | Soaking temperature (° C.) | Soaking time (min) | Hot forming: Heating temperature (° C.) | Hot forming: Finishing temperature (° C.) | Hot forming: Average cooling rate (° C./s) | Ratio of bainite (%) | Ferrite grain size number (—) | Hardness in hot rolling HV (HV) | Limiting compressibility: Hot (%) | Limiting compressibility: Cold (%) | Machinability $VL_{1000}$ (m/min) | Coarsening temperature in carburizing (° C.) | Fatigue life of carburized material (Relative value) (—) |
|---|---|---|---|---|---|---|---|---|---|---|---|---|---|---|
| Comparative Example | 48 | 1280 | 20 | 1050 | 940 | 0.52 | 0 | 9 | 170 | 94 | 55 | 45 | 930 | 1.0 |
| | 49 | 1280 | 20 | 1050 | 940 | 0.48 | 0 | 9 | 167 | 85 | 49 | 49 | 930 | 0.8 |
| | 50 | 1280 | 20 | 1050 | 940 | 0.51 | 0 | 10 | 176 | 78 | 45 | 53 | 950 | 0.7 |
| | 51 | 1280 | 20 | 1050 | 940 | 0.56 | 5 | 8 | 173 | 94 | 50 | 25 | 930 | 1.4 |
| | 52 | 1280 | 20 | 1050 | 940 | 0.47 | 6 | 8 | 180 | 82 | 47 | 32 | 940 | 1.2 |
| | 53 | 1280 | 20 | 1050 | 940 | 0.50 | 4 | 9 | 185 | 72 | 42 | 40 | 960 | 0.8 |
| | 54 | 1150 | 20 | 1240 | 930 | 0.53 | 0 | 9 | 182 | 85 | 52 | 46 | 960 | 2.4 |
| | 55 | 1150 | 20 | 1250 | 940 | 0.52 | 0 | 9 | 176 | 80 | 49 | 52 | 980 | 1.6 |
| | 56 | 1150 | 20 | 1210 | 930 | 0.52 | 0 | 11 | 190 | 76 | 44 | 62 | 1000 | 0.8 |
| | 57 | 1150 | 20 | 1220 | 940 | 0.57 | 0 | 9 | 184 | 83 | 52 | 48 | 950 | 2.0 |
| | 58 | 1150 | 20 | 1220 | 950 | 0.46 | 0 | 9 | 187 | 82 | 51 | 51 | 970 | 1.9 |
| | 59 | 1150 | 20 | 1220 | 950 | 0.51 | 0 | 11 | 175 | 76 | 45 | 61 | 1010 | 1.1 |
| | 60 | 1280 | 20 | 1030 | 930 | 0.51 | 0 | 10 | 177 | 92 | 59 | 44 | 950 | 2.2 |
| | 61 | 1280 | 20 | 1040 | 950 | 0.56 | 0 | 10 | 181 | 90 | 56 | 52 | 930 | 1.7 |
| | 62 | 1280 | 20 | 1040 | 940 | 0.45 | 0 | 11 | 193 | 84 | 52 | 59 | 940 | 1.0 |
| | 63 | 1280 | 20 | 1220 | 950 | 0.52 | 0 | 9 | 186 | 81 | 45 | 35 | 940 | 2.4 |
| | 64 | 1280 | 20 | 1220 | 950 | 0.46 | 0 | 10 | 184 | 75 | 42 | 45 | 940 | 1.5 |
| | 65 | 1280 | 20 | 1220 | 930 | 0.51 | 0 | 9 | 180 | 70 | 36 | 51 | 930 | 0.7 |
| | 66 | 1150 | 20 | 1220 | 930 | 0.48 | 13 | 10 | 210 | 93 | 51 | 30 | 950 | 2.5 |
| | 67 | 1150 | 20 | 1220 | 930 | 0.51 | 18 | 10 | 206 | 89 | 44 | 40 | 930 | 1.6 |
| | 68 | 1150 | 20 | 1220 | 930 | 0.49 | 12 | 11 | 206 | 85 | 41 | 45 | 940 | 0.9 |
| | 69 | 1150 | 30 | 1220 | 940 | 0.46 | 13 | 9 | 199 | 87 | 44 | 28 | 950 | 2.4 |
| | 70 | 1150 | 30 | 1220 | 940 | 0.55 | 11 | 10 | 215 | 84 | 40 | 36 | 940 | 1.7 |
| | 71 | 1150 | 30 | 1220 | 930 | 0.49 | 11 | 11 | 211 | 80 | 38 | 42 | 930 | 0.8 |
| | 72 | 1280 | 30 | 1210 | 940 | 0.49 | 0 | 10 | 185 | 65 | 44 | 20 | 1060 | 2.2 |
| | 73 | 1280 | 30 | 1230 | 930 | 0.52 | 0 | 9 | 189 | 60 | 41 | 25 | 1070 | 2.3 |
| | 74 | 1280 | 30 | 1210 | 930 | 0.52 | 0 | 11 | 190 | 54 | 38 | 30 | 1060 | 1.9 |
| | 75 | 1280 | 20 | 1220 | 940 | 0.52 | 0 | 8 | 182 | 92 | 58 | 47 | 980 | 1.6 |
| | 76 | 1280 | 20 | 1220 | 950 | 0.55 | 0 | 10 | 176 | 89 | 57 | 53 | 980 | 1.0 |
| | 77 | 1280 | 20 | 1240 | 940 | 0.47 | 0 | 10 | 186 | 86 | 54 | 60 | 990 | 0.4 |
| | 78 | 1280 | 20 | 1210 | 940 | 1.34 | 35 | 10 | 275 | 93 | 62 | 15 | 930 | 2.8 |
| | 79 | 1280 | 30 | 1260 | 950 | 0.55 | 0 | 9 | 252 | 93 | 50 | 25 | 950 | 0.7 |

In Examples (Nos. 1 to 47), the coarsening temperatures of the crystal grains were 990° C. or more, prior γ grains of the steel carburized at 950° C. also were fine and uniform grains, and the rolling fatigue characteristics also were more improved compared to No. 48. Also with respect to cold forgeability and machinability, it was clear that Nos. 1 to 47 were more improved compared to Comparative Examples of the similar chemical composition (particularly, amount of S).

Nos. 48 to 53 (Comparative Example, the conventional steel) are SCr 420 and SCM 420 equivalent steels which are general steels for carburization, or steels in which S is added to the steels for carburization. In order to compare with Nos. 1 to 47, Nos. 48 to 53 secured the similar soaking temperature as that of Nos. 1 to 47 by being sufficiently heated. However, the general soaking temperature was about 1150° C. In addition, in Nos. 48 to 53, the heating temperature of hot forming was controlled to 1050° C. which was a general heating temperature.

As a result, comparing Nos. 48 to 53, as shown in the conventional example of FIGS. 2A and 2B, it is found that cold forgeability and hot forgeability decreases as machinability increases.

That is, in Nos. 48 to 53, the amount of S had great influences. When the amount of S in the steel was low and forgeability, characteristics preventing coarsening, and fatigue characteristics were excellent, since the machinability was deteriorated, productivity was necessarily decreased with respect to use of gears or the like which need cutting. When S is added to the steel in order to improve the machinability, the size of MnS increases and forgeability is adversely affected. In this way, the forgeability and the machinability had a trade-off relationship, and it was difficult to achieve both.

In contrast, in the present invention, it is possible to achieve both the machinability and the forgeability. The balance is shown in FIGS. 2A and 2B. In FIG. 2A, the amount of S is changed in SCr 420 equivalent steel which includes about 0.2 mass % of C and about 1 mass % of Cr. Moreover, in FIG. 2B, the amount of S is changed in SCM 420 equivalent steel in which Mo of an amount of about 0.2% is added to the SCr 420 equivalent steel. In addition, in the inventive steel of FIGS. 2A and 2B, the shape and the grain size distribution (based on number) of MnS is controlled by the control of the cooling rate during casting, and pinning characteristics are improved by adding Ti or the like to the steel (SCr 420 equivalent steel and SCM 420 equivalent steel). From FIGS. 2A and 2B, it is understood that both machinability and forgeability of the inventive steels are improved compared to the conventional steels.

Here, the SCr 420 equivalent steel and the SCM 420 equivalent steel are designed so as to be suitable to the carburizing and the quenching, the hardenability of the SCM 420 equivalent steel is higher than that of the SCr 420 equivalent steel. Therefore, the SCM 420 equivalent can be used in larger parts or higher strength parts. However, since the hardness is high at the time of forming before the carburizing and quenching due to addition of Mo in the SCM 420 equivalent steel, both cold forgeability and machinability of the SCM 420 equivalent steel are lower compared to those of the SCr 420 equivalent steel. In this way, the balance between the cold forgeability and the machinability is may be changed according to the kind of the steel, and the balance further including the hardenability is secured.

In Nos. 54 to 59 (Comparative Examples), the soaking temperature was less than 1250° C., coarsening of the sulfide progressed, and the number of large sulfides was large in view of Equation 2. Among these, in Comparative Examples 54 to 56, since the cooling rate during the solidification was controlled to 0.3° C./min by winding a heat insulating material to the mold, or the like, the maximum sulfide size was large when Equation 3 was considered.

In this way, in Nos. 54 to 59, since the grain size distribution of the sulfide was not appropriately controlled compared to the steel of Examples (for example, comparison of No. 2 and No. 54) having the chemical composition with the same levels, forgeability was deteriorated, Ti was insufficiently dissolved, and therefore the coarsening temperature was low.

In Nos. 60 to 62 (Comparative Examples), the amount of added Ti was small, sufficient pinning particles could not be obtained during carburizing, and since the heating during hot forming before the carburizing was insufficient, Ti was insufficiently dissolved, and therefore the coarsening temperature was lower.

In Nos. 63 to 65 (Comparative Examples), since the amount of N was more than 0.0050% and Ti easily generated TiN, the solute Ti decreased, and accordingly, the amount (number) of the fine precipitates such as TiCN and TiC which was important as the pinning particles during the carburizing decreased. As a result, a pinning effect was insufficient, and the coarsening temperature of prior γ grain during carburizing decreased. Moreover, in Nos. 63 to 65, since a large amount of N was included in the steel, the large amount of N became a cause of flaws in hot rolling or hot forging. In addition, compared to the steel of Examples (for example, comparison of No. 1 or No. 2 and No. 63) having the chemical composition with the same level except for the amount of N, in Nos. 63 to 65, the limiting compressibility in hot forging was lower. Also from the practical aspects, it is preferable that the amount of N is as small as possible and it is more preferable that the amount of N is 0.0040% or less.

Nos. 66 to 71 are Comparative Examples of 0.4% C class. However, in Nos. 66 to 71, similar to Nos. 54 to 59 described above, the soaking temperature was less than 1250° C., and it was understood that the grain size distribution of the sulfide was not suitably controlled. Moreover, in Nos. 66 to 71, since Ti was insufficiently dissolved, the coarsening temperature also was low.

In Nos. 72 to 74 (Comparative Examples), 0.04% or more of Nb was added to the steel. Nb is effective for pinning particles during carburizing similarly to Ti. However, addition of a large amount of Nb decreases hot ductility, and become a cause of flaws in hot rolling or hot forging. Thereby, compared to the steel of Examples (for example, comparison of No. 24 and No. 72) having the chemical composition with the same levels except for the amount of Nb, in Nos. 72 to 74, limiting compressibility in hot forging was considerably low, and limiting compressibility in cold forging also was low.

In Nos. 75 to 77 (Comparative Examples), since the amount of Ti was less than 0.05% and sufficient pinning particles could not be obtained during carburizing, compared to the steel of Examples (for example, comparison of No. 1 and No. 75) having the chemical composition with the same level except for the amount of Ti, the coarsening temperature was low.

In No. 78 (Comparative Example), since the amount of Ti was less than 0.05% and sufficient pinning particles could not be obtained during carburizing, the coarsening temperature decreased. Moreover, in No. 75, since the cooling rate before carburizing after heating was rapid, compared to Nos. 1 to 47, the hardness was higher, and machinability was lower. In addition, in No. 78, the rate of bainite was more than 30%.

In No. 79 (Comparative Example), the amount of Ti was more than 0.2%, coarse Ti-based precipitates were generated, and the coarsening temperature decreased. That is, if the amount of Ti is excessive, since Ti (Ti-based precipitates) cannot sufficiently dissolve in the steel during soaking and hot forming, the solute Ti is preferentially precipitated on the undissolved coarse Ti-based precipitates. Thereby, since pinning particles (fine Ti-based precipitates) could not be sufficiently obtained before the carburizing, the coarsening temperature decreased. Moreover, in No. 79, since coarse Ti-based precipitates were generated, compared to No. 1, machinability was lower, the coarse Ti-based precipitates acted as the fracture starting point in a fatigue test, the fatigue characteristics were unstable, and the fatigue life also decreased.

Moreover, after the steel having chemical compositions shown in Tables 10 to 13 was melted in a vacuum melting furnace, the steel was cast at an average solidification rate shown in Tables 18 to 21. Blanks of the chemical components in Tables 10 to 13 mean that the chemical components are not intentionally added, and underlines mean that conditions of chemical components of the present invention are not satisfied. Moreover, the balance of chemical components shown in Tables 10 to 13 is Fe and inevitable impurities.

Hot forming was performed with respect to the steel which was cast as described above, and steel bars having diameters of 24 to 30 mm were manufactured. In Tables 18 to 21, the average solidification rate, the heating temperature of hot forming, the finishing temperature, the average cooling rate, the ratio of bainite, and the grain size number of ferrite are shown. Here, underlines in Tables 18 to 21 mean that the manufacturing conditions of the present invention are not satisfied. In addition, the estimation method of the manufacturing conditions (determination method of average solidification rate and definition of average cooling rate) and the estimation method of the microstructure (ratio of bainite and ferrite grain size number) are the same as methods described in Nos. 1 to 79.

In Tables 14 to 17, maximum equivalent circle diameters (maximum size and maximum diameter) D of the sulfides in the steel, density d of sulfides more than 0.5 μm (number density), the precipitation amount of AlN, and maximum equivalent circle diameters of Ti-based precipitates (maximum size and maximum diameter) are shown. Here, underlines in Tables 14 to 17 mean that the conditions of the density d of the sulfide according to the present invention were not satisfied. In addition, the methods of measuring the maximum equivalent circle diameters of the sulfide, the density of the sulfide which is more than 0.5 μm, and the maximum equivalent circle diameters of the Ti-based precipitates were the same as the methods described in Nos. 1 to 79. Moreover, the precipitation amount of AlN was measured by a chemical analysis using the above-described bromine methanol.

In addition, in Tables 18 to 21, the Vickers hardness, the limiting compressibility, the machinability $VL_{1000}$, the coarsening temperature during carburizing, and the fatigue life of the carburized material are shown. The characteristics of the steel were measured (estimated) by the same measurement method (estimation method) as the method described in Nos. 1 to 79.

As shown in Tables 18 to 21, in Nos. 101 to 133 (Examples) and Nos. 150 to 173 (Examples), the carburizing could be efficiently performed and good fatigue results could be obtained. On the other hand, in Nos. 137 to 146 (Comparative Examples) and 174 to 197 (Comparative Examples), coarse particles of Ti-based precipitates such as TiN and Ti-based complex sulfide and the sulfide such as MnS acted as fracture starting points, strain according to generation of the coarse grains (coarse grains of prior austenite) decreased the test accuracy, or the coarse grains (coarse grains of prior austenite) themselves became the fracture starting point. Therefore, good test results were not obtained in some of the tests.

TABLE 10

| | | Chemical component mass % | | | | | | | | | |
|---|---|---|---|---|---|---|---|---|---|---|---|
| | No. | C | Si | Mn | P | S | Cr | Ti | Nb | Mo | Ni |
| Example | 101 | 0.21 | 0.24 | 1.01 | 0.020 | 0.011 | 1.09 | 0.14 | | | |
| | 102 | 0.20 | 0.19 | 1.56 | 0.012 | 0.016 | 1.06 | 0.14 | | | |
| | 103 | 0.19 | 0.22 | 1.55 | 0.024 | 0.016 | 1.29 | 0.09 | | | |
| | 104 | 0.20 | 0.22 | 1.62 | 0.014 | 0.013 | 1.29 | 0.11 | | | |
| | 105 | 0.22 | 0.21 | 0.63 | 0.017 | 0.039 | 1.22 | 0.10 | | | |
| | 106 | 0.21 | 0.23 | 1.71 | 0.016 | 0.026 | 1.25 | 0.08 | | | |
| | 107 | 0.20 | 0.23 | 0.98 | 0.011 | 0.046 | 1.27 | 0.11 | | | |
| | 108 | 0.19 | 0.22 | 0.95 | 0.006 | 0.046 | 1.16 | 0.07 | | | |
| | 109 | 0.20 | 0.25 | 0.45 | 0.011 | 0.046 | 1.22 | 0.09 | | | |
| | 110 | 0.20 | 0.22 | 1.29 | 0.013 | 0.014 | 1.08 | 0.13 | 0.016 | | |
| | 111 | 0.19 | 0.20 | 0.78 | 0.025 | 0.016 | 1.07 | 0.14 | 0.015 | | |
| | 112 | 0.20 | 0.24 | 1.69 | 0.012 | 0.010 | 1.24 | 0.05 | 0.010 | | |
| | 113 | 0.20 | 0.23 | 1.76 | 0.012 | 0.017 | 1.26 | 0.10 | 0.009 | | |
| | 114 | 0.21 | 0.20 | 0.78 | 0.015 | 0.015 | 1.18 | 0.15 | 0.020 | | 0.30 |
| | 115 | 0.20 | 0.22 | 1.24 | 0.023 | 0.011 | 1.25 | 0.12 | 0.014 | | |
| | 116 | 0.22 | 0.19 | 0.97 | 0.007 | 0.015 | 1.27 | 0.11 | 0.021 | | |
| | 117 | 0.19 | 0.19 | 0.75 | 0.008 | 0.017 | 1.09 | 0.13 | 0.018 | | |
| | 118 | 0.18 | 0.18 | 0.67 | 0.016 | 0.039 | 1.10 | 0.07 | 0.010 | | |
| | 119 | 0.19 | 0.24 | 1.74 | 0.017 | 0.034 | 1.20 | 0.09 | 0.016 | | |
| | 120 | 0.19 | 0.19 | 0.60 | 0.024 | 0.030 | 1.06 | 0.06 | 0.013 | | |
| | 121 | 0.18 | 0.25 | 0.58 | 0.015 | 0.034 | 1.12 | 0.07 | 0.016 | | |
| | 122 | 0.21 | 0.22 | 1.25 | 0.018 | 0.041 | 1.23 | 0.07 | 0.023 | | |
| | 123 | 0.20 | 0.20 | 0.80 | 0.016 | 0.044 | 1.14 | 0.06 | 0.020 | | 0.45 |
| | 124 | 0.21 | 0.23 | 1.19 | 0.015 | 0.049 | 1.09 | 0.10 | 0.017 | | |
| | 125 | 0.20 | 0.19 | 0.40 | 0.017 | 0.014 | 1.16 | 0.15 | | 0.13 | |
| | 126 | 0.19 | 0.24 | 0.67 | 0.022 | 0.016 | 1.05 | 0.13 | | 0.12 | |
| | 127 | 0.21 | 0.24 | 1.32 | 0.009 | 0.039 | 1.07 | 0.13 | 0.005 | 0.15 | |
| | 128 | 0.21 | 0.23 | 1.18 | 0.012 | 0.042 | 1.09 | 0.13 | 0.019 | 0.16 | |
| | 129 | 0.21 | 0.19 | 1.33 | 0.006 | 0.038 | 1.20 | 0.11 | 0.005 | 0.13 | |
| | 130 | 0.20 | 0.18 | 0.99 | 0.010 | 0.018 | 1.15 | 0.05 | | | |
| | 131 | 0.19 | 0.19 | 0.34 | 0.015 | 0.025 | 1.10 | 0.10 | | | |
| | 132 | 0.22 | 0.19 | 0.77 | 0.014 | 0.016 | 1.12 | 0.11 | 0.020 | | |
| | 133 | 0.19 | 0.21 | 1.53 | 0.008 | 0.038 | 1.10 | 0.09 | 0.012 | 0.14 | |

| | | Chemical component mass % | | | | | | | |
|---|---|---|---|---|---|---|---|---|---|
| | No. | V | B | Al | N | Zr | Mg | Ca | O |
| Example | 101 | | | 0.036 | 0.0034 | | | 0.0016 | 0.0014 |
| | 102 | | | 0.036 | 0.0047 | 0.0019 | | 0.0012 | 0.0011 |
| | 103 | | | 0.034 | 0.0046 | | 0.0019 | 0.0010 | 0.0014 |
| | 104 | | | 0.020 | 0.0038 | 0.0014 | 0.0010 | 0.0009 | 0.0014 |
| | 105 | | | 0.010 | 0.0029 | | | 0.0004 | 0.0012 |
| | 106 | | | 0.024 | 0.0027 | 0.0019 | 0.0005 | 0.0016 | 0.0012 |
| | 107 | | | 0.039 | 0.0046 | | 0.0011 | 0.0017 | 0.0010 |
| | 108 | | | 0.034 | 0.0037 | 0.0009 | 0.0018 | 0.0007 | 0.0011 |
| | 109 | | | 0.120 | 0.0026 | | | 0.0010 | 0.0013 |
| | 110 | | | 0.034 | 0.0037 | | | 0.0011 | 0.0014 |
| | 111 | | | 0.008 | 0.0033 | 0.0019 | | 0.0006 | 0.0014 |
| | 112 | | | 0.039 | 0.0032 | | 0.0019 | 0.0009 | 0.0011 |
| | 113 | 0.13 | | 0.033 | 0.0035 | 0.0025 | 0.0014 | 0.0018 | 0.0014 |
| | 114 | | | 0.030 | 0.0028 | 0.0009 | 0.0018 | 0.0013 | 0.0013 |
| | 115 | | | 0.014 | 0.0027 | 0.0009 | 0.0017 | 0.0007 | 0.0011 |
| | 116 | | 0.0015 | 0.017 | 0.0039 | 0.0010 | 0.0011 | 0.0017 | 0.0012 |
| | 117 | | | 0.091 | 0.0027 | | | 0.0010 | 0.0013 |
| | 118 | | | 0.022 | 0.0047 | | | 0.0016 | 0.0011 |
| | 119 | | | 0.023 | 0.0026 | 0.0027 | 0.0007 | 0.0003 | 0.0013 |
| | 120 | | | 0.006 | 0.0026 | | 0.0006 | 0.0013 | 0.0013 |
| | 121 | | | 0.036 | 0.0045 | 0.0026 | 0.0014 | 0.0017 | 0.0011 |
| | 122 | 0.21 | | 0.022 | 0.0045 | 0.0011 | 0.0009 | 0.0016 | 0.0013 |
| | 123 | | | 0.015 | 0.0044 | 0.0008 | 0.0009 | 0.0009 | 0.0011 |
| | 124 | | 0.0016 | 0.026 | 0.0030 | 0.0026 | 0.0008 | 0.0011 | 0.0010 |
| | 125 | | | 0.030 | 0.0047 | | | 0.0009 | 0.0013 |
| | 126 | | | 0.033 | 0.0037 | 0.0015 | | 0.0019 | 0.0011 |
| | 127 | | | 0.044 | 0.0034 | | | 0.0013 | 0.0015 |
| | 128 | | | 0.007 | 0.0046 | 0.0021 | 0.0018 | 0.0006 | 0.0014 |
| | 129 | | | 0.041 | 0.0031 | | 0.0004 | 0.0012 | 0.0012 |

TABLE 10-continued

| | | | | | | |
|---|---|---|---|---|---|---|
| 130 | 0.008 | 0.0030 | 0.0006 | 0.0004 | 0.0010 |
| 131 | 0.010 | 0.0042 | 0.0027 | 0.0011 | 0.0010 |
| 132 | 0.021 | 0.0043 | 0.0006 | 0.0017 | 0.0011 |
| 133 | 0.026 | 0.0038 | 0.0030 | 0.0007 | 0.0010 |

TABLE 11

| | | Chemical component mass % | | | | | | | | | | | | | | | | | |
|---|---|---|---|---|---|---|---|---|---|---|---|---|---|---|---|---|---|---|---|
| | No. | C | Si | Mn | P | S | Cr | Ti | Nb | Mo | Ni | V | B | Al | N | Zr | Mg | Ca | O |
| Comparative Example | 137 | 0.21 | 0.25 | 0.94 | 0.012 | 0.012 | 1.14 | — | | | | | | 0.035 | 0.0126 | | | | 0.0014 |
| | 138 | 0.21 | 0.19 | 0.60 | 0.006 | 0.048 | 1.19 | 0.13 | | | | | | 0.036 | 0.0032 | | | 0.0012 | 0.0012 |
| | 139 | 0.21 | 0.21 | 1.49 | 0.009 | 0.036 | 1.24 | 0.06 | | | | | | 0.006 | 0.0036 | | | 0.0004 | 0.0010 |
| | 140 | 0.21 | 0.19 | 0.80 | 0.020 | 0.016 | 1.24 | 0.08 | | | | | | 0.022 | 0.0077 | | | 0.0007 | 0.0014 |
| | 141 | 0.18 | 0.20 | 0.63 | 0.020 | 0.029 | 1.10 | 0.05 | | | | | | 0.025 | 0.0102 | | | 0.0006 | 0.0013 |
| | 142 | 0.20 | 0.19 | 0.89 | 0.019 | 0.017 | 1.22 | 0.30 | | | | | | 0.006 | 0.0042 | 0.0017 | | 0.0015 | 0.0014 |
| | 143 | 0.19 | 0.25 | 0.74 | 0.022 | 0.016 | 1.22 | 0.10 | 0.120 | | | | | 0.012 | 0.0028 | | | 0.0017 | 0.0013 |
| | 144 | 0.19 | 0.22 | 1.15 | 0.021 | 0.013 | 1.26 | 0.08 | 0.120 | | | | | 0.038 | 0.0026 | 0.0008 | | 0.0009 | 0.0012 |
| | 145 | 0.21 | 0.18 | 1.14 | 0.012 | 0.031 | 1.13 | 0.05 | | | | | | 0.006 | 0.0030 | 0.0011 | | | 0.0035 |
| | 146 | 0.20 | 0.20 | 2.10 | 0.025 | 0.027 | 1.90 | 0.12 | | | | | | 0.033 | 0.0027 | 0.0018 | | 0.0012 | 0.0014 |

TABLE 12

| | | Chemical component mass % | | | | | | | | | | | | | | | | | |
|---|---|---|---|---|---|---|---|---|---|---|---|---|---|---|---|---|---|---|---|
| | No. | C | Si | Mn | P | S | Cr | Ti | Nb | Mo | Ni | V | B | Al | N | Zr | Mg | Ca | O |
| Example | 150 | 0.19 | 0.24 | 0.90 | 0.017 | 0.015 | 1.07 | 0.10 | | | | | | 0.030 | 0.0050 | | | | 0.0011 |
| | 151 | 0.22 | 0.19 | 1.11 | 0.025 | 0.017 | 1.26 | 0.08 | 0.011 | | | | | 0.033 | 0.0043 | | | | 0.0012 |
| | 152 | 0.19 | 0.20 | 0.35 | 0.011 | 0.011 | 1.20 | 0.09 | | | | | | 0.011 | 0.0041 | | | 0.0014 | 0.0013 |
| | 153 | 0.21 | 0.21 | 0.63 | 0.007 | 0.012 | 1.13 | 0.07 | 0.011 | | | | | 0.030 | 0.0041 | | | 0.0011 | 0.0012 |
| | 154 | 0.20 | 0.20 | 0.40 | 0.015 | 0.012 | 1.21 | 0.06 | | | | | | 0.042 | 0.0029 | 0.0028 | | 0.0011 | 0.0013 |
| | 155 | 0.21 | 0.23 | 0.68 | 0.014 | 0.015 | 1.18 | 0.10 | 0.018 | | | | | 0.035 | 0.0048 | 0.0020 | | 0.0018 | 0.0012 |
| | 156 | 0.21 | 0.18 | 1.27 | 0.013 | 0.012 | 1.27 | 0.09 | | 0.13 | | | | 0.025 | 0.0043 | | | | 0.0014 |
| | 157 | 0.19 | 0.25 | 0.71 | 0.008 | 0.015 | 1.08 | 0.09 | 0.023 | 0.15 | | | | 0.008 | 0.0035 | | | | 0.0011 |
| | 158 | 0.21 | 0.21 | 1.74 | 0.022 | 0.015 | 1.21 | 0.07 | | 0.12 | | | | 0.010 | 0.0041 | | | 0.0011 | 0.0011 |
| | 159 | 0.21 | 0.24 | 1.54 | 0.014 | 0.011 | 1.21 | 0.08 | 0.018 | 0.15 | | | | 0.015 | 0.0036 | | | 0.0008 | 0.0013 |
| | 160 | 0.21 | 0.22 | 0.45 | 0.016 | 0.015 | 1.17 | 0.08 | | 0.16 | | | | 0.023 | 0.0036 | 0.0006 | | 0.0016 | 0.0012 |
| | 161 | 0.19 | 0.23 | 0.49 | 0.014 | 0.015 | 1.15 | 0.10 | 0.012 | 0.13 | | | | 0.037 | 0.0039 | 0.0024 | | 0.0005 | 0.0011 |
| | 162 | 0.20 | 0.23 | 1.78 | 0.018 | 0.048 | 1.23 | 0.08 | | | | | | 0.025 | 0.0027 | | | | 0.0011 |
| | 163 | 0.20 | 0.21 | 1.52 | 0.023 | 0.045 | 1.23 | 0.08 | 0.017 | | | | | 0.007 | 0.0032 | | | | 0.0011 |
| | 164 | 0.20 | 0.22 | 1.17 | 0.006 | 0.036 | 1.19 | 0.08 | | | | | | 0.011 | 0.0025 | | | 0.0010 | 0.0012 |
| | 165 | 0.18 | 0.20 | 0.81 | 0.016 | 0.031 | 1.13 | 0.05 | 0.020 | | | | | 0.023 | 0.0036 | | | 0.0005 | 0.0013 |
| | 166 | 0.19 | 0.24 | 1.42 | 0.015 | 0.033 | 1.08 | 0.12 | | | | | | 0.021 | 0.0034 | 0.0028 | | 0.0008 | 0.0013 |
| | 167 | 0.21 | 0.24 | 1.62 | 0.020 | 0.046 | 1.26 | 0.06 | 0.013 | | | | | 0.041 | 0.0037 | 0.0004 | | 0.0007 | 0.0011 |
| | 168 | 0.20 | 0.18 | 0.96 | 0.013 | 0.029 | 1.22 | 0.06 | | 0.13 | | | | 0.043 | 0.0034 | | | | 0.0012 |
| | 169 | 0.22 | 0.20 | 1.25 | 0.018 | 0.044 | 1.13 | 0.10 | 0.021 | 0.12 | | | | 0.044 | 0.0027 | | | | 0.0013 |
| | 170 | 0.18 | 0.23 | 1.56 | 0.020 | 0.041 | 1.28 | 0.11 | | 0.16 | | | | 0.013 | 0.0028 | | | 0.0008 | 0.0012 |
| | 171 | 0.21 | 0.20 | 1.29 | 0.016 | 0.046 | 1.28 | 0.14 | 0.024 | 0.14 | | | | 0.014 | 0.0027 | | | 0.0010 | 0.0010 |
| | 172 | 0.18 | 0.22 | 0.51 | 0.008 | 0.028 | 1.10 | 0.13 | | 0.12 | | | | 0.038 | 0.0045 | 0.0026 | | 0.0018 | 0.0014 |
| | 173 | 0.20 | 0.24 | 1.57 | 0.013 | 0.029 | 1.12 | 0.07 | 0.021 | 0.13 | | | | 0.043 | 0.0038 | 0.0019 | | 0.0012 | 0.0012 |

TABLE 13

| | | Chemical component mass % | | | | | | | | | | | | | | | | | |
|---|---|---|---|---|---|---|---|---|---|---|---|---|---|---|---|---|---|---|---|
| | No. | C | Si | Mn | P | S | Cr | Ti | Nb | Mo | Ni | V | B | Al | N | Zr | Mg | Ca | O |
| Comparative Example | 174 | 0.19 | 0.23 | 0.44 | 0.017 | 0.012 | 1.13 | 0.12 | | | | | | 0.041 | 0.0038 | | | | 0.0015 |
| | 175 | 0.19 | 0.25 | 1.30 | 0.008 | 0.016 | 1.17 | 0.11 | 0.020 | | | | | 0.008 | 0.0031 | | | | 0.0014 |
| | 176 | 0.21 | 0.24 | 1.20 | 0.023 | 0.010 | 1.25 | 0.06 | | | | | | 0.043 | 0.0047 | | | 0.0019 | 0.0014 |
| | 177 | 0.21 | 0.22 | 0.47 | 0.019 | 0.011 | 1.11 | 0.11 | 0.008 | | | | | 0.013 | 0.0046 | | | 0.0007 | 0.0014 |
| | 178 | 0.20 | 0.23 | 1.09 | 0.025 | 0.013 | 1.14 | 0.07 | | | | | | 0.034 | 0.0050 | 0.0017 | | 0.0018 | 0.0011 |
| | 179 | 0.20 | 0.19 | 1.53 | 0.023 | 0.017 | 1.23 | 0.14 | 0.015 | | | | | 0.008 | 0.0048 | 0.0014 | | 0.0012 | 0.0013 |

TABLE 13-continued

| No. | Chemical component mass % | | | | | | | | | | | | | | | | |
|---|---|---|---|---|---|---|---|---|---|---|---|---|---|---|---|---|---|
| | C | Si | Mn | P | S | Cr | Ti | Nb | Mo | Ni | V | B | Al | N | Zr | Mg | Ca | O |
| 180 | 0.22 | 0.22 | 0.50 | 0.015 | 0.015 | 1.20 | 0.07 | | 0.15 | | | | 0.038 | 0.0038 | | | | 0.0012 |
| 181 | 0.19 | 0.19 | 0.71 | 0.018 | 0.014 | 1.26 | 0.09 | 0.019 | 0.14 | | | | 0.011 | 0.0045 | | | | 0.0012 |
| 182 | 0.20 | 0.23 | 0.62 | 0.016 | 0.012 | 1.07 | 0.08 | | 0.14 | | | | 0.019 | 0.0034 | | | 0.0017 | 0.0012 |
| 183 | 0.19 | 0.24 | 1.44 | 0.020 | 0.011 | 1.23 | 0.12 | 0.017 | 0.14 | | | | 0.032 | 0.0034 | | | 0.0015 | 0.0012 |
| 184 | 0.19 | 0.19 | 1.37 | 0.007 | 0.013 | 1.09 | 0.13 | | 0.14 | | | | 0.036 | 0.0034 | 0.0022 | | 0.0017 | 0.0013 |
| 185 | 0.21 | 0.23 | 0.79 | 0.017 | 0.016 | 1.06 | 0.12 | 0.010 | 0.13 | | | | 0.024 | 0.0032 | 0.0006 | | 0.0018 | 0.0013 |
| 186 | 0.18 | 0.19 | 1.78 | 0.021 | 0.045 | 1.27 | 0.10 | | | | | | 0.016 | 0.0029 | | | | 0.0015 |
| 187 | 0.20 | 0.18 | 0.76 | 0.025 | 0.031 | 1.07 | 0.06 | 0.013 | | | | | 0.032 | 0.0025 | | | | 0.0012 |
| 188 | 0.20 | 0.18 | 0.52 | 0.013 | 0.035 | 1.07 | 0.05 | | | | | | 0.023 | 0.0048 | | | 0.0004 | 0.0011 |
| 189 | 0.18 | 0.22 | 0.86 | 0.016 | 0.027 | 1.28 | 0.11 | 0.009 | | | | | 0.044 | 0.0029 | | | 0.0015 | 0.0014 |
| 190 | 0.21 | 0.24 | 1.03 | 0.008 | 0.032 | 1.25 | 0.06 | | | | | | 0.036 | 0.0036 | 0.0006 | | 0.0019 | 0.0011 |
| 191 | 0.22 | 0.21 | 0.51 | 0.018 | 0.027 | 1.27 | 0.14 | 0.019 | | | | | 0.031 | 0.0041 | 0.0017 | | 0.0018 | 0.0013 |
| 192 | 0.20 | 0.20 | 0.61 | 0.022 | 0.047 | 1.25 | 0.15 | | 0.14 | | | | 0.006 | 0.0036 | | | | 0.0014 |
| 193 | 0.21 | 0.21 | 0.54 | 0.007 | 0.045 | 1.20 | 0.07 | 0.016 | 0.13 | | | | 0.015 | 0.0026 | | | | 0.0010 |
| 194 | 0.21 | 0.19 | 0.37 | 0.007 | 0.041 | 1.09 | 0.06 | | 0.14 | | | | 0.018 | 0.0037 | | | 0.0009 | 0.0013 |
| 195 | 0.20 | 0.25 | 1.02 | 0.006 | 0.038 | 1.28 | 0.08 | 0.010 | 0.13 | | | | 0.036 | 0.0049 | | | 0.0007 | 0.0014 |
| 196 | 0.20 | 0.18 | 0.41 | 0.013 | 0.033 | 1.24 | 0.15 | | 0.14 | | | | 0.009 | 0.0046 | 0.0020 | | 0.0006 | 0.0012 |
| 197 | 0.20 | 0.18 | 1.44 | 0.015 | 0.044 | 1.22 | 0.13 | 0.024 | 0.16 | | | | 0.017 | 0.0041 | 0.0019 | | 0.0011 | 0.0011 |

TABLE 14

| | No. | Maximum equivalent circle diameter of sulfide D | | Density of sulfide more than 5 μm d | | Precipitation | Maximum equivalent circle diameter |
|---|---|---|---|---|---|---|---|
| | | Measured value (μm) | 250 × [S] + 10 (μm) | Measured value (particles/mm$^2$) | 500 × [S] + 1 (particles/mm$^2$) | amount of AlN (%) | of Ti-based precipitates (μm) |
| Example | 101 | 8 | 13 | 1.3 | 6.4 | 0.003 | 20 |
| | 102 | 11 | 14 | 1.6 | 8.9 | 0.004 | 30 |
| | 103 | 7 | 14 | 0.2 | 8.9 | 0.003 | 21 |
| | 104 | 9 | 13 | 1.3 | 7.5 | 0.003 | 28 |
| | 105 | 15 | 20 | 4.5 | 20.7 | 0.002 | 29 |
| | 106 | 11 | 17 | 3.9 | 14.1 | 0.004 | 27 |
| | 107 | 12 | 22 | 5.0 | 24.2 | 0.003 | 23 |
| | 108 | 14 | 21 | 3.9 | 24.0 | 0.004 | 20 |
| | 109 | 15 | 21 | 0.1 | 23.9 | 0.003 | 29 |
| | 110 | 9 | 14 | 1.6 | 8.2 | 0.004 | 24 |
| | 111 | 8 | 14 | 1.8 | 9.2 | 0.004 | 22 |
| | 112 | 10 | 13 | 1.6 | 6.2 | 0.004 | 30 |
| | 113 | 9 | 14 | 0.8 | 9.5 | 0.003 | 28 |
| | 114 | 9 | 14 | 1.7 | 8.7 | 0.002 | 23 |
| | 115 | 7 | 13 | 2.0 | 6.3 | 0.004 | 31 |
| | 116 | 9 | 14 | 0.4 | 8.6 | 0.002 | 20 |
| | 117 | 7 | 14 | 0.7 | 9.7 | 0.002 | 23 |
| | 118 | 15 | 20 | 3.3 | 20.5 | 0.002 | 22 |
| | 119 | 10 | 18 | 3.4 | 17.8 | 0.004 | 24 |
| | 120 | 11 | 17 | 5.0 | 15.9 | 0.003 | 28 |
| | 121 | 14 | 19 | 4.9 | 18.2 | 0.004 | 23 |
| | 122 | 11 | 20 | 4.3 | 21.6 | 0.004 | 29 |
| | 123 | 13 | 21 | 3.2 | 23.2 | 0.002 | 25 |
| | 124 | 15 | 22 | 3.8 | 25.3 | 0.002 | 31 |
| | 125 | 11 | 13 | 1.5 | 7.9 | 0.003 | 31 |
| | 126 | 8 | 14 | 0.9 | 8.9 | 0.003 | 25 |
| | 127 | 10 | 20 | 3.2 | 20.6 | 0.002 | 23 |
| | 128 | 13 | 21 | 3.9 | 22.2 | 0.003 | 21 |
| | 129 | 12 | 20 | 5.0 | 20.1 | 0.002 | 20 |
| | 130 | 7 | 14 | 0.6 | 10.0 | 0.004 | 52 |
| | 131 | 8 | 16 | 4.3 | 13.5 | 0.002 | 54 |
| | 132 | 11 | 14 | 0.0 | 9.1 | 0.003 | 52 |
| | 133 | 11 | 20 | 3.7 | 20.1 | 0.004 | 53 |

TABLE 15

| | No. | Maximum equivalent circle diameter of sulfide D: Measured value (μm) | Maximum equivalent circle diameter of sulfide D: 250 × [S] + 10 (μm) | Density of sulfide more than 5 μm d: Measured value (particles/mm$^2$) | Density of sulfide more than 5 μm d: 500 × [S] + 1 (particles/mm$^2$) | Precipitation amount of AlN (%) | Maximum equivalent circle diameter of Ti-based precipitates (μm) |
|---|---|---|---|---|---|---|---|
| Comparative Example | 137 | 9 | 13 | 12.2 | 7.0 | 0.002 | — |
| | 138 | 15 | 22 | 36.4 | 25.1 | 0.002 | 27 |
| | 139 | 11 | 19 | 34.8 | 19.0 | 0.003 | 26 |
| | 140 | 11 | 14 | 1.6 | 8.9 | 0.003 | 21 |
| | 141 | 9 | 17 | 4.3 | 15.4 | 0.003 | 26 |
| | 142 | 9 | 14 | 4.3 | 9.3 | 0.003 | 66 |
| | 143 | 12 | 14 | 1.7 | 8.9 | 0.002 | 23 |
| | 144 | 10 | 13 | 1.8 | 7.4 | 0.002 | 32 |
| | 145 | 14 | 18 | 4.3 | 16.4 | 0.003 | 31 |
| | 146 | 12 | 17 | 4.7 | 14.6 | 0.003 | 20 |

TABLE 16

| | No. | Maximum equivalent circle diameter of sulfide D: Measured value (μm) | Maximum equivalent circle diameter of sulfide D: 250 × [S] + 10 (μm) | Density of sulfide more than 5 μm d: Measured value (particles/mm$^2$) | Density of sulfide more than 5 μm d: 500 × [S] + 1 (particles/mm$^2$) | Precipitation amount of AlN (%) | Maximum equivalent circle diameter of Ti-based precipitates (μm) |
|---|---|---|---|---|---|---|---|
| Example | 150 | 7 | 14 | 1.8 | 8.6 | 0.003 | 25 |
| | 151 | 12 | 14 | 1.1 | 9.6 | 0.003 | 31 |
| | 152 | 11 | 13 | 0.1 | 6.6 | 0.003 | 29 |
| | 153 | 8 | 13 | 0.9 | 6.9 | 0.002 | 23 |
| | 154 | 8 | 13 | 0.4 | 6.9 | 0.003 | 27 |
| | 155 | 7 | 14 | 0.2 | 8.5 | 0.003 | 25 |
| | 156 | 7 | 13 | 1.6 | 7.1 | 0.002 | 29 |
| | 157 | 11 | 14 | 0.9 | 8.6 | 0.003 | 30 |
| | 158 | 10 | 14 | 1.3 | 8.4 | 0.003 | 23 |
| | 159 | 9 | 13 | 0.6 | 6.5 | 0.003 | 26 |
| | 160 | 9 | 14 | 0.5 | 8.4 | 0.004 | 25 |
| | 161 | 10 | 14 | 0.6 | 8.7 | 0.003 | 26 |
| | 162 | 12 | 22 | 3.5 | 24.9 | 0.002 | 20 |
| | 163 | 16 | 21 | 4.4 | 23.6 | 0.003 | 26 |
| | 164 | 11 | 19 | 3.9 | 19.1 | 0.002 | 22 |
| | 165 | 9 | 18 | 3.5 | 16.5 | 0.004 | 28 |
| | 166 | 14 | 18 | 4.5 | 17.5 | 0.003 | 21 |
| | 167 | 13 | 21 | 4.9 | 23.8 | 0.004 | 26 |
| | 168 | 9 | 17 | 4.0 | 15.3 | 0.003 | 24 |
| | 169 | 13 | 21 | 4.1 | 22.9 | 0.003 | 31 |
| | 170 | 14 | 20 | 4.7 | 21.4 | 0.004 | 23 |
| | 171 | 13 | 22 | 4.1 | 24.2 | 0.004 | 30 |
| | 172 | 13 | 17 | 3.9 | 14.9 | 0.003 | 22 |
| | 173 | 13 | 17 | 4.9 | 15.3 | 0.003 | 28 |

TABLE 17

| | No. | Maximum equivalent circle diameter of sulfide D: Measured value (μm) | Maximum equivalent circle diameter of sulfide D: 250 × [S] + 10 (μm) | Density of sulfide more than 5 μm d: Measured value (particles/mm$^2$) | Density of sulfide more than 5 μm d: 500 × [S] + 1 (particles/mm$^2$) | Precipitation amount of AlN (%) | Maximum equivalent circle diameter of Ti-based precipitates (μm) |
|---|---|---|---|---|---|---|---|
| Comparative Example | 174 | 21 | 13 | 20.9 | 6.9 | 0.003 | 20 |
| | 175 | 21 | 14 | 21.1 | 9.1 | 0.004 | 22 |
| | 176 | 19 | 13 | 10.2 | 6.0 | 0.003 | 30 |
| | 177 | 21 | 13 | 17.7 | 6.7 | 0.003 | 20 |
| | 178 | 19 | 13 | 21.6 | 7.4 | 0.003 | 28 |
| | 179 | 20 | 14 | 15.7 | 9.4 | 0.003 | 31 |
| | 180 | 20 | 14 | 17.3 | 8.7 | 0.003 | 25 |
| | 181 | 21 | 14 | 15.9 | 8.2 | 0.002 | 28 |
| | 182 | 20 | 13 | 13.3 | 7.0 | 0.002 | 29 |

TABLE 17-continued

| No. | Maximum equivalent circle diameter of sulfide D: Measured value (μm) | Maximum equivalent circle diameter of sulfide D: 250 × [S] + 10 (μm) | Density of sulfide more than 5 μm d: Measured value (particles/mm$^2$) | Density of sulfide more than 5 μm d: 500 × [S] + 1 (particles/mm$^2$) | Precipitation amount of AlN (%) | Maximum equivalent circle diameter of Ti-based precipitates (μm) |
|---|---|---|---|---|---|---|
| 183 | 20 | 13 | 18.2 | 6.4 | 0.003 | 26 |
| 184 | 19 | 13 | 14.6 | 7.6 | 0.004 | 22 |
| 185 | 20 | 14 | 11.9 | 9.1 | 0.003 | 21 |
| 186 | 24 | 21 | 28.4 | 23.6 | 0.004 | 22 |
| 187 | 22 | 18 | 37.6 | 16.4 | 0.003 | 29 |
| 188 | 22 | 19 | 28.0 | 18.6 | 0.003 | 28 |
| 189 | 22 | 17 | 33.8 | 14.3 | 0.002 | 27 |
| 190 | 24 | 18 | 25.2 | 17.2 | 0.004 | 25 |
| 191 | 23 | 17 | 33.8 | 14.6 | 0.002 | 29 |
| 192 | 24 | 22 | 33.5 | 24.5 | 0.003 | 22 |
| 193 | 24 | 21 | 30.0 | 23.4 | 0.003 | 27 |
| 194 | 23 | 20 | 31.6 | 21.7 | 0.002 | 25 |
| 195 | 23 | 19 | 36.6 | 20.0 | 0.003 | 24 |
| 196 | 24 | 18 | 28.1 | 17.4 | 0.002 | 31 |
| 197 | 25 | 21 | 35.1 | 22.8 | 0.004 | 25 |

TABLE 18

| | No. | Average solidification cooling rate (° C./min) | Soaking temperature (° C.) | Soaking time (min) | Hot forming: Heating temperature (° C.) | Hot forming: Finishing temperature (° C.) | Hot forming: Average cooling rate (° C./s) | Ratio of bainite (%) | Ferrite grain size number (—) |
|---|---|---|---|---|---|---|---|---|---|
| Example | 101 | 18 | 1280 | 20 | 1230 | 940 | 0.54 | 0 | 10.4 |
| | 102 | 19 | 1280 | 20 | 1230 | 950 | 0.46 | 0 | 9.4 |
| | 103 | 15 | 1280 | 20 | 1230 | 940 | 0.46 | 0 | 9.6 |
| | 104 | 16 | 1280 | 20 | 1240 | 930 | 0.57 | 0 | 9.7 |
| | 105 | 16 | 1280 | 20 | 1250 | 950 | 0.50 | 0 | 9 |
| | 106 | 18 | 1280 | 20 | 1230 | 950 | 0.50 | 0 | 9.8 |
| | 107 | 20 | 1280 | 20 | 1230 | 950 | 0.48 | 0 | 10.2 |
| | 108 | 20 | 1280 | 20 | 1270 | 930 | 0.50 | 0 | 9.3 |
| | 109 | 18 | 1280 | 20 | 1200 | 940 | 0.52 | 0 | 9 |
| | 110 | 20 | 1280 | 20 | 1260 | 950 | 0.46 | 0 | 9.1 |
| | 111 | 20 | 1280 | 20 | 1210 | 940 | 0.54 | 0 | 9.1 |
| | 112 | 18 | 1280 | 30 | 1270 | 940 | 0.50 | 0 | 8.8 |
| | 113 | 15 | 1280 | 30 | 1250 | 940 | 0.54 | 0 | 10.4 |
| | 114 | 14 | 1280 | 30 | 1270 | 950 | 0.47 | 0 | 8.9 |
| | 115 | 13 | 1280 | 30 | 1260 | 940 | 0.49 | 0 | 9.8 |
| | 116 | 19 | 1280 | 30 | 1210 | 940 | 0.56 | 0 | 9.4 |
| | 117 | 19 | 1280 | 30 | 1230 | 940 | 0.47 | 0 | 10 |
| | 118 | 14 | 1280 | 30 | 1250 | 930 | 0.50 | 0 | 9.7 |
| | 119 | 17 | 1280 | 30 | 1260 | 930 | 0.54 | 0 | 10.4 |
| | 120 | 14 | 1280 | 30 | 1200 | 940 | 0.52 | 0 | 9 |
| | 121 | 12 | 1280 | 30 | 1230 | 950 | 0.52 | 0 | 9.7 |
| | 122 | 20 | 1280 | 30 | 1270 | 950 | 0.55 | 0 | 10.5 |
| | 123 | 20 | 1280 | 30 | 1270 | 940 | 0.50 | 0 | 10.1 |
| | 124 | 19 | 1280 | 30 | 1210 | 940 | 0.47 | 0 | 9.6 |
| | 125 | 13 | 1280 | 30 | 1200 | 930 | 0.46 | 4 | 10.3 |
| | 126 | 16 | 1280 | 30 | 1250 | 930 | 0.47 | 7 | 10 |
| | 127 | 17 | 1280 | 30 | 1210 | 950 | 0.53 | 8 | 10 |
| | 128 | 16 | 1280 | 30 | 1260 | 940 | 0.46 | 7 | 8.8 |
| | 129 | 13 | 1280 | 30 | 1200 | 950 | 0.47 | 8 | 10.3 |
| | 130 | 13 | 1280 | 30 | 1150 | 950 | 0.47 | 0 | 8.9 |
| | 131 | 12 | 1280 | 30 | 1160 | 940 | 0.56 | 0 | 10.2 |
| | 132 | 14 | 1280 | 30 | 1180 | 940 | 0.56 | 0 | 9.7 |
| | 133 | 14 | 1280 | 30 | 1170 | 950 | 0.45 | 0 | 8.9 |

| | No. | Hardness in hot rolling HV (HV) | Limiting compressibility: Hot (%) | Limiting compressibility: Cold (%) | Machinability $VL_{1000}$ (m/min) | Coarsening temperature in carburizing (° C.) | Fatigue life of carburized material (Relative value) (—) |
|---|---|---|---|---|---|---|---|
| Example | 101 | 183 | 93 | 62 | 49 | 1060 | 3.7 |
| | 102 | 172 | 94 | 60 | 50 | 1060 | 3.0 |
| | 103 | 193 | 93 | 62 | 48 | 1060 | 3.3 |

TABLE 18-continued

| | | | | | | |
|---|---|---|---|---|---|---|
| 104 | 180 | 93 | 65 | 48 | 1080 | 3.3 |
| 105 | 179 | 88 | 51 | 52 | 1060 | 2.6 |
| 106 | 184 | 91 | 52 | 54 | 1060 | 2.6 |
| 107 | 175 | 91 | 50 | 51 | 1070 | 2.8 |
| 108 | 177 | 90 | 52 | 51 | 1050 | 2.6 |
| 109 | 187 | 93 | 63 | 75 | 1050 | 3.4 |
| 110 | 177 | 94 | 63 | 48 | 1060 | 3.1 |
| 111 | 184 | 93 | 62 | 50 | 1060 | 3.6 |
| 112 | 183 | 93 | 65 | 47 | 1070 | 3.7 |
| 113 | 185 | 93 | 64 | 48 | 1070 | 3.1 |
| 114 | 173 | 93 | 63 | 45 | 1070 | 3.1 |
| 115 | 189 | 95 | 61 | 49 | 1070 | 3.7 |
| 116 | 188 | 94 | 62 | 48 | 1060 | 3.7 |
| 117 | 180 | 95 | 62 | 60 | 1060 | 3.2 |
| 118 | 182 | 90 | 53 | 52 | 1060 | 2.6 |
| 119 | 185 | 89 | 50 | 55 | 1050 | 2.6 |
| 120 | 184 | 91 | 50 | 53 | 1070 | 2.7 |
| 121 | 178 | 90 | 52 | 51 | 1070 | 2.7 |
| 122 | 190 | 88 | 50 | 50 | 1050 | 2.8 |
| 123 | 177 | 90 | 54 | 51 | 1070 | 2.7 |
| 124 | 194 | 92 | 51 | 51 | 1060 | 2.9 |
| 125 | 195 | 95 | 61 | 42 | 1060 | 3.7 |
| 126 | 206 | 93 | 58 | 42 | 1060 | 3.9 |
| 127 | 200 | 91 | 50 | 47 | 1060 | 2.7 |
| 128 | 192 | 91 | 50 | 47 | 1070 | 2.7 |
| 129 | 198 | 91 | 51 | 50 | 1070 | 2.5 |
| 130 | 177 | 79 | 63 | 42 | 1010 | 3.7 |
| 131 | 193 | 70 | 55 | 54 | 1010 | 2.6 |
| 132 | 191 | 78 | 60 | 54 | 1020 | 3.2 |
| 133 | 182 | 73 | 50 | 40 | 1020 | 2.5 |

TABLE 19

| | | Average | | | Hot forming | | | | Ferrite |
|---|---|---|---|---|---|---|---|---|---|
| | No. | solidification cooling rate (° C./min) | Soaking temperature (° C.) | Soaking time (min) | Heating temperature (° C.) | Finishing temperature (° C.) | Average cooling rate (° C./s) | Ratio of bainite (%) | grain size number (—) |
| Comparative Example | 137 | 18 | 1280 | 30 | 1270 | 940 | 0.47 | 0 | 9 |
| | 138 | 17 | 1150 | 30 | 1260 | 940 | 0.48 | 0 | 9.5 |
| | 139 | 13 | 1150 | 30 | 1230 | 950 | 0.49 | 0 | 9.6 |
| | 140 | 15 | 1280 | 30 | 1220 | 940 | 0.49 | 0 | 9.9 |
| | 141 | 14 | 1280 | 30 | 1250 | 940 | 0.48 | 0 | 9.9 |
| | 142 | 18 | 1280 | 30 | 1220 | 940 | 0.53 | 0 | 9.5 |
| | 143 | 13 | 1280 | 30 | 1210 | 930 | 0.47 | 0 | 9.9 |
| | 144 | 16 | 1280 | 30 | 1250 | 940 | 0.55 | 0 | 9.8 |
| | 145 | 12 | 1280 | 30 | 1240 | 930 | 0.51 | 0 | 10.1 |
| | 146 | 15 | 1280 | 30 | 1230 | 930 | 1.50 | 35 | 9.2 |

| | | Hardness in hot rolling | Limiting compressibility | | Machinability | Coarsening temperature in | Fatigue life of carburized material |
|---|---|---|---|---|---|---|---|
| | No. | HV (HV) | Hot (%) | Cold (%) | $VL_{1000}$ (m/min) | carburizing (° C.) | (Relative value) (—) |
| Comparative Example | 137 | 165 | 93 | 60 | 40 | 930 | 3.5 |
| | 138 | 194 | 76 | 46 | 45 | 1080 | 2.6 |
| | 139 | 175 | 78 | 44 | 48 | 1050 | 2.9 |
| | 140 | 191 | 79 | 50 | 28 | 950 | 3.4 |
| | 141 | 186 | 74 | 46 | 33 | 920 | 2.7 |
| | 142 | 225 | 93 | 55 | 26 | 950 | 1.3 |
| | 143 | 240 | 60 | 53 | 43 | 1070 | 3.4 |
| | 144 | 230 | 66 | 53 | 43 | 1080 | 3.2 |
| | 145 | 186 | 91 | 63 | 35 | 1060 | 2.7 |
| | 146 | 234 | 88 | 52 | 28 | 1080 | 2.6 |

TABLE 20

| | No. | Average solidification cooling rate (° C./min) | Soaking temperature (° C.) | Soaking time (min) | Hot forming: Heating temperature (° C.) | Hot forming: Finishing temperature (° C.) | Hot forming: Average cooling rate (° C./s) | Ratio of bainite (%) | Ferrite grain size number (—) |
|---|---|---|---|---|---|---|---|---|---|
| Example | 150 | 20 | 1280 | 30 | 1250 | 940 | 0.47 | 0 | 10.2 |
| | 151 | 13 | 1280 | 30 | 1260 | 940 | 0.49 | 0 | 9.8 |
| | 152 | 14 | 1280 | 30 | 1270 | 950 | 0.56 | 0 | 9.9 |
| | 153 | 15 | 1280 | 30 | 1210 | 940 | 0.48 | 0 | 9.6 |
| | 154 | 16 | 1280 | 30 | 1220 | 940 | 0.45 | 0 | 10 |
| | 155 | 13 | 1280 | 30 | 1260 | 940 | 0.50 | 0 | 10.3 |
| | 156 | 13 | 1280 | 30 | 1260 | 940 | 0.46 | 0 | 9.3 |
| | 157 | 15 | 1280 | 30 | 1270 | 940 | 0.55 | 0 | 9.9 |
| | 158 | 14 | 1280 | 30 | 1230 | 940 | 0.47 | 0 | 9 |
| | 159 | 15 | 1280 | 30 | 1220 | 950 | 0.54 | 0 | 10.2 |
| | 160 | 19 | 1280 | 30 | 1200 | 940 | 0.54 | 0 | 10.4 |
| | 161 | 20 | 1280 | 30 | 1230 | 940 | 0.47 | 0 | 9.4 |
| | 162 | 18 | 1280 | 30 | 1250 | 930 | 0.54 | 0 | 9.3 |
| | 163 | 15 | 1280 | 30 | 1220 | 930 | 0.49 | 0 | 8.9 |
| | 164 | 13 | 1280 | 30 | 1240 | 950 | 0.50 | 0 | 10.4 |
| | 165 | 16 | 1280 | 30 | 1220 | 950 | 0.52 | 0 | 9.9 |
| | 166 | 18 | 1280 | 30 | 1210 | 940 | 0.45 | 0 | 10.5 |
| | 167 | 16 | 1280 | 30 | 1200 | 940 | 0.52 | 0 | 8.9 |
| | 168 | 13 | 1280 | 30 | 1260 | 940 | 0.50 | 0 | 10.1 |
| | 169 | 15 | 1280 | 30 | 1230 | 950 | 0.46 | 0 | 9.9 |
| | 170 | 15 | 1280 | 30 | 1250 | 940 | 0.48 | 0 | 9 |
| | 171 | 14 | 1280 | 30 | 1220 | 930 | 0.49 | 0 | 8.9 |
| | 172 | 16 | 1280 | 30 | 1200 | 940 | 0.48 | 0 | 9.7 |
| | 173 | 14 | 1280 | 30 | 1230 | 950 | 0.55 | 0 | 9.3 |

| | No. | Hardness in hot rolling HV (HV) | Limiting compressibility: Hot (%) | Limiting compressibility: Cold (%) | Machinability $VL_{1000}$ (m/min) | Coarsening temperature in carburizing (° C.) | Fatigue life of carburized material (Relative value) (—) |
|---|---|---|---|---|---|---|---|
| Example | 150 | 191 | 94 | 62 | 46 | 1060 | 3.2 |
| | 151 | 188 | 94 | 62 | 46 | 1060 | 3.3 |
| | 152 | 191 | 92 | 60 | 47 | 1070 | 3.2 |
| | 153 | 176 | 93 | 60 | 45 | 1060 | 3.6 |
| | 154 | 184 | 94 | 63 | 48 | 1080 | 3.6 |
| | 155 | 172 | 92 | 63 | 49 | 1070 | 3.5 |
| | 156 | 181 | 92 | 63 | 47 | 1080 | 3.7 |
| | 157 | 176 | 95 | 62 | 49 | 1080 | 3.3 |
| | 158 | 189 | 95 | 62 | 50 | 1050 | 3.0 |
| | 159 | 180 | 94 | 64 | 46 | 1070 | 3.2 |
| | 160 | 181 | 93 | 64 | 49 | 1070 | 3.5 |
| | 161 | 188 | 94 | 65 | 49 | 1060 | 3.7 |
| | 162 | 186 | 92 | 52 | 55 | 1070 | 2.8 |
| | 163 | 183 | 92 | 52 | 53 | 1050 | 2.9 |
| | 164 | 195 | 90 | 53 | 53 | 1050 | 3.0 |
| | 165 | 190 | 88 | 54 | 55 | 1050 | 2.6 |
| | 166 | 176 | 91 | 53 | 55 | 1070 | 2.9 |
| | 167 | 189 | 92 | 52 | 53 | 1050 | 2.9 |
| | 168 | 173 | 91 | 50 | 52 | 1070 | 2.9 |
| | 169 | 186 | 89 | 55 | 52 | 1080 | 2.9 |
| | 170 | 188 | 89 | 51 | 53 | 1060 | 2.6 |
| | 171 | 185 | 88 | 54 | 53 | 1080 | 2.6 |
| | 172 | 193 | 88 | 54 | 55 | 1070 | 2.9 |
| | 173 | 178 | 89 | 52 | 53 | 1060 | 2.6 |

TABLE 21

| | No. | Average solidification cooling rate (° C./min) | Soaking temperature (° C.) | Soaking time (min) | Hot forming: Heating temperature (° C.) | Hot forming: Finishing temperature (° C.) | Hot forming: Average cooling rate (° C./s) | Ratio of bainite (%) | Ferrite grain size number (—) |
|---|---|---|---|---|---|---|---|---|---|
| Comparative Example | 174 | 6 | 1280 | 20 | 1260 | 940 | 0.53 | 0 | 8.8 |
| | 175 | 11 | 1280 | 20 | 1210 | 950 | 0.54 | 0 | 9.6 |
| | 176 | 8 | 1280 | 20 | 1240 | 930 | 0.46 | 0 | 9.5 |
| | 177 | 9 | 1280 | 20 | 1240 | 940 | 0.54 | 0 | 9.5 |

TABLE 21-continued

| | | | | | | | | |
|---|---|---|---|---|---|---|---|---|
| 178 | 8 | 1280 | 20 | 1200 | 950 | 0.47 | 0 | 8.8 |
| 179 | 11 | 1280 | 20 | 1200 | 940 | 0.55 | 0 | 9.7 |
| 180 | 6 | 1280 | 20 | 1230 | 930 | 0.49 | 0 | 9.6 |
| 181 | 8 | 1280 | 20 | 1220 | 940 | 0.47 | 0 | 9.7 |
| 182 | 5 | 1280 | 20 | 1210 | 930 | 0.55 | 0 | 9.4 |
| 183 | 6 | 1280 | 30 | 1240 | 950 | 0.45 | 0 | 10.1 |
| 184 | 10 | 1280 | 30 | 1230 | 930 | 0.55 | 0 | 10.1 |
| 185 | 5 | 1280 | 30 | 1220 | 940 | 0.53 | 0 | 10.3 |
| 186 | 5 | 1280 | 30 | 1230 | 950 | 0.48 | 0 | 9.9 |
| 187 | 7 | 1280 | 30 | 1250 | 950 | 0.52 | 0 | 9.5 |
| 188 | 7 | 1280 | 30 | 1210 | 940 | 0.48 | 0 | 10.1 |
| 189 | 4 | 1280 | 30 | 1220 | 940 | 0.51 | 0 | 10.3 |
| 190 | 9 | 1280 | 30 | 1220 | 930 | 0.56 | 0 | 9.3 |
| 191 | 8 | 1280 | 30 | 1250 | 950 | 0.49 | 0 | 9.5 |
| 192 | 10 | 1280 | 30 | 1230 | 940 | 0.50 | 0 | 9.5 |
| 193 | 8 | 1280 | 30 | 1250 | 940 | 0.49 | 0 | 9.4 |
| 194 | 8 | 1280 | 30 | 1250 | 940 | 0.51 | 0 | 9.2 |
| 195 | 4 | 1280 | 30 | 1220 | 940 | 0.53 | 0 | 9.1 |
| 196 | 6 | 1280 | 30 | 1240 | 950 | 0.52 | 0 | 9.9 |
| 197 | 9 | 1280 | 30 | 1240 | 930 | 0.54 | 0 | 8.9 |

| | | Hardness in hot rolling | Limiting compressibility | | Machinability | Coarsening temperature in | Fatigue life of carburized material |
|---|---|---|---|---|---|---|---|
| | No. | HV (HV) | Hot (%) | Cold (%) | $VL_{1000}$ (m/min) | carburizing (° C.) | (Relative value) (—) |
| Comparative Example | 174 | 190 | 79 | 55 | 48 | 1060 | 1.9 |
| | 175 | 189 | 79 | 52 | 48 | 1080 | 2.0 |
| | 176 | 195 | 77 | 50 | 48 | 1080 | 1.9 |
| | 177 | 185 | 77 | 52 | 47 | 1060 | 1.8 |
| | 178 | 177 | 77 | 50 | 48 | 1070 | 1.9 |
| | 179 | 194 | 77 | 54 | 48 | 1070 | 2.0 |
| | 180 | 189 | 80 | 51 | 49 | 1060 | 2.0 |
| | 181 | 175 | 80 | 53 | 50 | 1060 | 1.9 |
| | 182 | 178 | 78 | 54 | 46 | 1060 | 1.7 |
| | 183 | 192 | 79 | 54 | 49 | 1070 | 2.0 |
| | 184 | 179 | 76 | 54 | 46 | 1050 | 2.1 |
| | 185 | 175 | 76 | 54 | 48 | 1060 | 1.8 |
| | 186 | 190 | 71 | 49 | 50 | 1070 | 1.1 |
| | 187 | 194 | 70 | 45 | 52 | 1050 | 0.9 |
| | 188 | 182 | 72 | 47 | 52 | 1070 | 1.0 |
| | 189 | 193 | 74 | 49 | 53 | 1050 | 0.8 |
| | 190 | 188 | 72 | 48 | 50 | 1060 | 1.2 |
| | 191 | 175 | 72 | 44 | 51 | 1060 | 1.1 |
| | 192 | 181 | 73 | 46 | 53 | 1080 | 0.9 |
| | 193 | 173 | 74 | 49 | 52 | 1060 | 1.3 |
| | 194 | 176 | 74 | 43 | 53 | 1060 | 1.0 |
| | 195 | 194 | 74 | 49 | 53 | 1080 | 1.3 |
| | 196 | 183 | 70 | 44 | 51 | 1060 | 1.1 |
| | 197 | 188 | 72 | 46 | 54 | 1050 | 1.2 |

In Nos. 101 to 133 (Examples) and Nos. 150 to 173 (Examples), the coarsening temperatures of the crystal grains were 990° C. or more, prior γ grains of the steel carburized at 950° C. also were uniform fine grains, and the rolling fatigue characteristics also were more improved compared to No. 48 described above. Also with respect to cold forgeability and machinability, it was clear that Nos. 101 to 133 and Nos. 150 to 173 were more improved compared to Comparative Examples of the similar chemical composition (particularly, amount to S). In addition, in Nos. 101 to 129, since the maximum equivalent circle diameters of the Ti-based precipitates were less than 40 μm, the coarsening temperature could be further increased rather than the steel of Examples (for example, comparison of No. 102 and No. 131) having chemical compositions with the same level.

In No. 137 (Comparative Example), since Ti was less than 0.05%, a pinning effect was insufficient, and the coarsening temperature of prior γ grain during carburizing decreased.

In Nos. 138 and 139 (Comparative Examples), the soaking temperature was less than 1250° C., coarsening of the sulfide progressed, and the number of large sulfides was large in view of Equation 2. In Nos. 138 and 139, since the grain size distribution of the sulfide was not appropriately controlled compared to the steel of Examples (for example, comparison of No. 109 and No. 138) having the chemical composition with the same levels, the forgeability was deteriorated.

In Nos. 140 to 141 (Comparative Examples), since the amount of N was more than 0.0050% and Ti (Ti-based precipitates) could not be sufficiently dissolved in the steel during soaking treatment and hot forming, and the amount (number) of the fine precipitates which was important as the pinning particles during the carburizing decreased. As a result, in Nos. 140 and 141, the pinning effect was insufficient, and the coarsening temperature of prior γ grain during carburizing decreased. In addition, compared to the steel of Examples (for example, comparison of No. 102 and No. 140) having the chemical composition with the same levels except for the amount of N, in Nos. 140 and 141, the limiting compressibility in hot forging was lower.

In No. 142 (Comparative Example), the amount of Ti was more than 0.2%, coarse Ti-based precipitates were generated, and the coarsening temperature decreased. Moreover, in No.

142, since coarse Ti-based precipitates were generated, compared to No. 102, machinability decreased, the coarse Ti-based precipitates acted as the fracture starting point in a fatigue test, the fatigue characteristics were unstable, and the fatigue life also decreased.

In Nos. 143 and 144 (Comparative Examples), the amount of Nb was 0.04% or more. Nb is effective as pinning particles during carburizing similar to Ti. However, a large amount of Nb decreases hot ductility, and becomes a cause of flaws in hot rolling or hot forging. Thereby, compared to the steel of Examples (for example, comparison of No. 110 and No. 143) having the chemical composition with the same level except for the amount of Nb, in Nos. 143 and 144, limiting compressibility in hot forging was considerably lower, and limiting compressibility in cold forging also was lower.

In No. 145 (Comparative Examples), since the amount of O is more than 0.0025%, compared to No. 106, machinability decreased. Moreover, in No. 145, the mechanism of oxide formation is different from those of Nos. 101 to 133, and nozzle clogging is easily generated.

In No. 146 (Comparative Example), the amount of Mn was more than 1.8% and the average cooling rate after hot forming was more than 1° C./second. Therefore, compared to Nos. 101 to 133, the hardness was higher, and the machinability was lower, in No. 146. In addition, in No. 146, the ratio of bainite was more than 30%.

In Nos. 174 to 197 (Comparative Examples), since the average solidification rate was less than 12° C./min, the number density d of the sulfides more than 5 μm did not satisfy Equation 2. Thereby, compared to the steel of Examples (for example, comparison of No. 150 and No. 174) having the chemical composition with the same level, in Nos. 174 to 197, the forgeability and fatigue resistance were lower. In addition, in Nos. 174 to 197, the maximum equivalent circle diameter D of the sulfide did not satisfy the above-described Equation 3.

In Nos. 1 to 47, 101 to 133, and 150 to 173, elements such as Ti and Nb (elements which form pinning particles) were added to the steel, the coarsening temperature during carburizing increased, and fatigue characteristics were improved. On the other hand, in many of Nos. 48 to 79, 137 to 146, and 174 to 197, the coarsening temperature was low, and γ grains were coarsened. Moreover, in Nos. 1 to 47, 101 to 133, and 150 to 173, in the manufacturing of parts which were formed by the cold forging, even when the normalizing is skipped prior to the carburizing, the carburizing can be performed while suppressing abnormal grain growth of the crystal grain, a decrease in fatigue characteristic induced to coarse grains can be suppressed, and it is possible to manufacture the parts efficiently.

As described above, it was confirmed that the steels of Nos. 1 to 47, 101 to 133, and 150 to 173 were the case hardening steel which had the excellent hot forgeability or the excellent cold forgeability, the excellent machinability, and the excellent fatigue characteristics after the carburizing and quenching.

INDUSTRIAL APPLICABILITY

It is possible to provide a case hardening steel and a manufacturing method thereof, the case hardening steel having excellent characteristics preventing coarse grains during carburizing and quenching (particularly, during high temperature carburizing), excellent fatigue characteristics after the carburizing and quenching (for example, rolling fatigue), and formability (strength characteristics) such as forgeability or machinability.

REFERENCE SYMBOL LIST

1: BLOOM
2: BLOOM CROSS SECTION
3: BLOOM SURFACE
4: TEST PIECE
5: GROOVED TEST PIECE
T: BLOOM THICKNESS
W: BLOOM WIDTH

What is claimed is:

1. A case hardening steel comprising: by mass %, as a chemical composition,
C: 0.1% to 0.5%,
Si: 0.01% to 1.5%
Mn: 0.3% to 1.8%,
S: 0.001% to 0.15%,
Cr: 0.4% to 2.0%,
Ti: 0.05% to 0.2%,
Al: limited to 0.2% or less,
N: limited to 0.0050% or less,
P: limited to 0.025% or less,
O: limited to 0.0025% or less, and
a balance of Fe and inevitable impurities,
wherein a number d of a sulfide having an equivalent circle diameter more than 5 μm per 1 $mm^2$ and a mass percentage [S] of S satisfy: $d \leq 500 \times [S]+1$.

2. The case hardening steel according to claim 1, further comprising, by mass %, as the chemical composition, at least one selected from:
Nb: less than 0.04%,
Mo: 1.5% or less,
Ni: 3.5% or less,
V: 0.5% or less,
B: 0.005% or less,
Ca: 0.005% or less,
Mg: 0.003% or less, and
Zr: 0.005% or less.

3. The case hardening steel according to claim 2, wherein an [Al]/[Ca] which is a ratio of a mass percentage [Al] of Al to a mass percentage [Ca] of Ca is 1 or more and 100 or less.

4. The case hardening steel according to claim 1 or 2, wherein a maximum equivalent circle diameter D μm of the sulfide and the mass percentage [S] of S satisfy: $D \leq 250 \times [S]+10$.

5. The case hardening steel according to claim 1 or 2, wherein an amount of Mn is 1.0% or less, and a [Mn]/[S] which is a ratio of a mass percentage [S] of S to a mass percentage [Mn] of Mn is 100 or less.

6. The case hardening steel according to claim 1 or 2, wherein a ratio of bainite is 30% or less in a microstructure.

7. The case hardening steel according to claim 1 or 2, wherein a maximum equivalent circle diameter of Ti-based precipitates is 40 μm or less.

8. A method of manufacturing a case hardening steel in which a number d of a sulfide having an equivalent circle diameter more than 5 μm per 1 $mm^2$ and a mass percentage [S] of S satisfy: $d \leq 500 \times [S]+1$, the method comprising:
casting a steel having a chemical composition which contains: by mass %, C: 0.1% to 0.5%, Si: 0.01% to 1.5%, Mn: 0.3% to 1.8%, S: 0.001% to 0.15%, Cr: 0.4% to 2.0%, Ti: 0.05% to 0.2%, Al: limited to 0.2% or less, N: limited to 0.0050% or less, P: limited to 0.025% or less, O: limited to 0.0025% or less, and the balance of iron and inevitable impurities, at an average cooling rate of 12 to 100° C./min;

soaking the steel for 3 to 180 min in a soaking temperature range of 1250° C. to 1320° C.;

hot-rolling the steel so that a finish rolling is performed in a finishing temperature range of 840° C. to 1000° C. after heating the steel in a temperature range of 1150° C. to 1320° C.; and cooling the steel so that an average cooling rate in a temperature range of 800° C. to 500° C. is 1° C./s or less.

9. The method of manufacturing the case hardening steel according to claim 8, wherein the chemical composition further contains: by mass %, at least one selected from: Nb: less than 0.04%, Mo: 1.5% or less, Ni: 3.5% or less, V: 0.5% or less, B: 0.005% or less, Ca: 0.005% or less, Mg: 0.003% or less, and Zr: 0.005% or less.

10. The method of manufacturing the case hardening steel according to claim 9, wherein an [Al]/[Ca] which is a ratio of a mass percentage [Al] of Al to a mass percentage [Ca] of Ca is 1 or more and 100 or less.

11. The method of manufacturing the case hardening steel according to claim 8 or 9, wherein an amount of Mn is 1.0% or less, and a [Mn]/[S] which is a ratio of a mass percentage [S] of S to a mass percentage [Mn] of Mn is 100 or less.

12. The case hardening steel according to claim 1, wherein S: 0.010% to 0.15%.

13. The method of manufacturing the case hardening steel according to claim 8, wherein S: 0.010% to 0.15%.

* * * * *

UNITED STATES PATENT AND TRADEMARK OFFICE

CERTIFICATE OF CORRECTION

PATENT NO. : 8,673,094 B2
APPLICATION NO. : 13/696714
DATED : March 18, 2014
INVENTOR(S) : Masayuki Hashimura et al.

It is certified that error appears in the above-identified patent and that said Letters Patent is hereby corrected as shown below:

In the Specification

Column 13, line 33, change “an countermeasure” to -- a countermeasure --;

Column 25, Table 6, Comparative Example 53, under the Measured value (particles/$mm^2$) column, change “49.3” to -- 59.3 --.

Signed and Sealed this
Twelfth Day of August, 2014

Michelle K. Lee

Michelle K. Lee
*Deputy Director of the United States Patent and Trademark Office*